US012091863B2

(12) United States Patent
Lorenz

(10) Patent No.: US 12,091,863 B2
(45) Date of Patent: Sep. 17, 2024

(54) FLOOD RESISTANT WALL

(71) Applicant: Alexander Lorenz, Wyckoff, NJ (US)

(72) Inventor: Alexander Lorenz, Wyckoff, NJ (US)

( * ) Notice: Subject to any disclaimer, the term of this patent is extended or adjusted under 35 U.S.C. 154(b) by 0 days.

(21) Appl. No.: 17/845,422

(22) Filed: Jun. 21, 2022

(65) Prior Publication Data

US 2023/0383543 A1 Nov. 30, 2023

Related U.S. Application Data

(60) Provisional application No. 63/253,165, filed on Oct. 7, 2021.

(51) Int. Cl.
*E04F 13/08* (2006.01)
*E04F 13/26* (2006.01)
*E04F 19/06* (2006.01)

(52) U.S. Cl.
CPC ..... *E04F 13/0841* (2013.01); *E04F 13/26* (2013.01); *E04F 19/065* (2013.01)

(58) Field of Classification Search
CPC ..... E04F 13/045; E04F 13/06; E04F 13/0841; E04F 13/0842; E04F 13/26;
(Continued)

(56) References Cited

U.S. PATENT DOCUMENTS 1,727,420 A * 9/1929 Walper ..... E04F 13/0841 52/489.1
2,188,090 A * 1/1940 Young ..... E04F 13/0841 52/459
(Continued)

FOREIGN PATENT DOCUMENTS

AT 11317 U1 * 6/2010 ..... A47B 96/067
AU 2010201523 A1 * 11/2010 ..... A47G 27/045
(Continued)

OTHER PUBLICATIONS

Rodriquez, Kari (authorized officer), ISA/US; International Search Report and Written Opinion mailed Jan. 3, 2023 for Appl. No. PCT/US22/44677, and references cited therein; pp. 1-13; Alexandria, VA.

*Primary Examiner* — Ryan D Kwiecinski
(74) *Attorney, Agent, or Firm* — Davis, Malm & D'Agostine, P.C.; Richard L. Sampson

(57) ABSTRACT

A modular water-resistant paneling system and method is configured for being retrofitted into walls of existing finished basements or buildings and/or used in new construction, using components fastenable onto wall studs supporting drywall. The components include dimensionally stable water-resistant panels, and finishing strips having a backing flange and an upper lip portion sized and shaped to receive upper edge portions of the panels therein. The backing flange is fastenable to the wall studs while maintaining the panels in spaced relation therefrom, to maintain interior facing surfaces of the panels and drywall flush with one another. The upper lip portion includes opposing flanges configured for superposed engagement with adjacent portions of the interior facing surfaces of the panels and drywall. Mounting clips are sized and shaped for receiving a stud therein, and have a support flange for supporting lower edge portions of the panels.

20 Claims, 25 Drawing Sheets

(58) Field of Classification Search
CPC . E04F 2013/063; E04F 19/061; E04F 19/062; E04F 19/063; E04F 19/064; E04F 19/065
See application file for complete search history.

(56) References Cited

U.S. PATENT DOCUMENTS 2,236,258 A * 3/1941 Burson ..... E04F 13/0821 52/285.3
2,258,574 A * 10/1941 Leary ..... E04B 2/842 52/285.3
2,348,658 A * 5/1944 Slaughter ..... E04F 19/065 52/631
3,485,001 A * 12/1969 Miller ..... E04F 19/06 52/764
3,606,714 A * 9/1971 Arnett ..... E04F 19/061 52/255
3,837,133 A * 9/1974 Mollman ..... E04F 13/0841 24/562
4,292,781 A * 10/1981 Chalmers ..... E04F 13/0803 52/409
4,356,673 A * 11/1982 Gailey ..... E04F 13/0842 52/514
4,435,933 A * 3/1984 Krowl ..... E04F 13/0864 52/522
4,449,338 A * 5/1984 Reicherts ..... E04F 13/0841 52/749.1
4,553,363 A * 11/1985 Weinar ..... E04F 19/06 52/718.04
4,782,642 A * 11/1988 Conville ..... E04G 23/0203 52/489.1
5,079,888 A * 1/1992 Hileman ..... E04G 23/0207 52/514
5,179,811 A * 1/1993 Walker ..... E04F 19/0436 52/718.02
D342,579 S * 12/1993 Mason ..... D25/119
5,974,753 A 11/1999 Hsu
6,209,277 B1 * 4/2001 DiGate ..... E04G 23/0203 52/715
6,238,773 B1 * 5/2001 Schluter ..... E04F 19/061 52/287.1
6,338,229 B1 * 1/2002 Botzen ..... E04F 19/061 52/287.1
6,385,932 B1 * 5/2002 Melchiori ..... E04F 13/06 52/302.6
6,460,311 B1 * 10/2002 Ito ..... E04F 13/0846 52/489.1
6,640,516 B1 * 11/2003 Thompson ..... E04C 3/12 52/715
6,725,619 B1 * 4/2004 Barber ..... E04F 13/0841 52/712
D529,630 S * 10/2006 Zarb ..... D25/119
7,313,891 B2 * 1/2008 Showers ..... E04B 1/7069 52/270
7,805,899 B2 10/2010 Montgomery
8,104,234 B1 * 1/2012 Sawyer ..... E04D 13/158 52/96
8,468,767 B1 * 6/2013 McBride ..... E04F 13/0803 52/471
8,590,249 B1 * 11/2013 Loper ..... E04F 13/0848 52/285.3
8,631,617 B2 * 1/2014 Janesky ..... E04F 19/064 52/282.1
8,667,765 B1 * 3/2014 McCarthy ..... E04F 13/0828 52/745.1
8,898,975 B2 * 12/2014 Tsai ..... E04F 13/144 52/235
9,051,736 B2 * 6/2015 Geels ..... E04F 13/0826
9,359,771 B1 * 6/2016 Delforte ..... E04F 13/083
9,366,040 B2 * 6/2016 Singh ..... E04F 19/065
D768,877 S * 10/2016 Mumford, Sr. ..... D25/119
9,534,412 B2 * 1/2017 DeRita ..... E04B 2/02
9,580,904 B2 * 2/2017 Krause ..... E04F 13/12
9,896,849 B1 * 2/2018 Aboukhalil ..... E04F 13/0803
10,174,510 B2 * 1/2019 Silk ..... E04F 19/0468
10,253,796 B2 * 4/2019 Carroll ..... F16B 5/128
10,316,525 B1 * 6/2019 Bilge ..... E04F 13/0814
10,494,818 B2 * 12/2019 Maziarz ..... E06B 7/2303
10,865,569 B1 * 12/2020 Bilge ..... E04F 19/061
11,047,139 B2 * 6/2021 Erickson ..... E04F 11/166
11,103,109 B2 8/2021 Schluter
11,199,009 B2 * 12/2021 Zhu ..... E04F 19/062
11,299,891 B1 * 4/2022 Nelson ..... E04F 13/0826
11,359,389 B2 * 6/2022 McCarthy ..... E04F 21/185
11,486,150 B2 * 11/2022 Stahl ..... E04F 21/0053
11,730,287 B1 * 8/2023 Kosch ..... E04F 13/0862 52/588.1
11,846,105 B2 * 12/2023 Matson ..... E04F 13/0828
2003/0113571 A1 6/2003 Lavoie et al.
2003/0221388 A1 * 12/2003 Benedettini ..... E04F 19/061 52/716.1
2004/0074188 A1 * 4/2004 Beck ..... E04F 13/0841 52/522
2004/0148893 A1 * 8/2004 Kornfalt ..... E04F 19/066 52/506.01
2005/0189723 A1 * 9/2005 Chassee ..... A47G 27/045 277/411
2005/0257461 A1 * 11/2005 Daly ..... E04F 19/064 52/254
2006/0070329 A1 * 4/2006 Schiltz ..... E04F 19/06 52/506.01
2007/0107348 A1 * 5/2007 Browne ..... E04F 19/063 52/417
2007/0130881 A1 * 6/2007 Birkett ..... B05D 7/06 52/783.1
2007/0193151 A1 8/2007 Anderson
2008/0008433 A1 * 1/2008 Parker ..... E04F 13/0803 385/128
2008/0010927 A1 * 1/2008 Wilson ..... E04F 13/18 52/387
2008/0016802 A1 1/2008 Rheaume
2008/0307747 A1 12/2008 Douglas
2009/0282759 A1 11/2009 Porter
2010/0083599 A1 * 4/2010 Meulemans ..... E04F 19/062 52/287.1
2010/0132295 A1 * 6/2010 Bootier ..... E04F 13/0841 52/582.1
2010/0236169 A1 * 9/2010 Pratt ..... E04F 19/066 52/287.1
2012/0255249 A1 * 10/2012 Singh ..... E04F 19/062 52/302.1
2013/0180202 A1 * 7/2013 Woods ..... A47B 95/008 52/710
2015/0027074 A1 * 1/2015 Preston ..... E04F 13/06 52/302.1
2015/0040510 A1 * 2/2015 Shaw ..... E04F 19/0468 52/718.04
2015/0129729 A1 * 5/2015 LaCerte ..... E04B 2/721 248/220.22
2016/0115696 A1 * 4/2016 Shaw ..... E04B 1/388 52/718.04
2016/0362898 A1 * 12/2016 Silk ..... E04F 19/0468
2018/0112414 A1 * 4/2018 Maziarz ..... E06B 7/2303
2018/0328027 A1 * 11/2018 Singh ..... E04B 1/6803
2020/0224428 A1 * 7/2020 Zhu ..... E04F 13/0803
2020/0318365 A1 * 10/2020 McCarthy ..... E04F 21/18
2021/0148122 A1 * 5/2021 De La O ..... E04F 19/0436
2021/0230887 A1 * 7/2021 Schluter ..... E04F 13/06
2021/0262240 A1 * 8/2021 Ben Saad ..... E04F 13/0841
2021/0317668 A1 * 10/2021 Ruggiero, Sr. ..... E04F 19/0463
2021/0355692 A1 * 11/2021 Jöneman ..... E04F 13/06
2021/0355693 A1 * 11/2021 Finley ..... E04F 19/064
2023/0021420 A1 * 1/2023 Micciantuono ..... E04F 19/061
2023/0068997 A1 * 3/2023 Mineo ..... E04F 13/06
2023/0106580 A1 * 4/2023 Maertens ..... E04F 13/0826 52/506.05

(56) References Cited

U.S. PATENT DOCUMENTS

| | | | | |
|---|---|---|---|---|
| 2023/0304305 | A1* | 9/2023 | Will | E04F 19/061 |
| 2023/0383543 | A1* | 11/2023 | Lorenz | E04F 19/063 |

FOREIGN PATENT DOCUMENTS

| | | | | | |
|---|---|---|---|---|---|
| CA | 2751134 | A1 | * | 12/2011 | E04F 19/061 |
| CA | 2896926 | A1 | * | 10/2015 | E04F 19/061 |
| CA | 2964871 | A1 | * | 10/2018 | E04B 1/40 |
| CA | 3050078 | A1 | * | 2/2020 | E04B 1/7038 |
| CN | 107476471 | A | * | 12/2017 | E04B 2/7407 |
| CN | 109736520 | A | * | 5/2019 | E04F 13/07 |
| CN | 111851911 | A | * | 10/2020 | |
| DE | 3136450 | A | * | 3/1983 | E04F 13/0842 |
| DE | 19754179 | C1 | * | 9/1999 | E04F 13/06 |
| DE | 20107557 | U1 | * | 8/2001 | E04F 13/06 |
| DE | 20305672 | U1 | * | 7/2003 | E04F 19/02 |
| DE | 20307556 | U1 | * | 8/2003 | E04F 13/06 |
| DE | 102005002054 | A1 | * | 7/2006 | E04F 13/0841 |
| DE | 102009047415 | A1 | * | 1/2011 | E04B 9/0435 |
| DE | 202010015402 | U1 | * | 3/2011 | E04F 13/06 |
| DE | 202012003472 | U1 | * | 8/2013 | E04F 19/061 |
| DE | 202017000471 | U1 | * | 3/2017 | |
| DE | 102018108816 | A1 | * | 10/2019 | E04F 13/06 |
| DE | 202020107127 | U1 | * | 2/2021 | |
| EP | 821120 | A1 | * | 1/1998 | E04F 13/06 |
| ES | 2364519 | A1 | * | 9/2011 | E04F 13/08 |
| GB | 2167797 | A | * | 6/1986 | E04F 13/04 |
| GB | 2232176 | A | * | 12/1990 | E04F 13/06 |
| GB | 2399830 | A | * | 9/2004 | E04F 19/06 |
| GB | 2445261 | A | * | 7/2008 | A61L 2/232 |
| GB | 2519780 | A | * | 5/2015 | A47B 95/043 |
| WO | WO-9716612 | A1 | * | 5/1997 | E04F 19/061 |
| WO | WO-0053854 | A1 | * | 9/2000 | E04F 13/0841 |
| WO | WO-0236901 | A1 | * | 5/2002 | E04F 13/06 |
| WO | WO-2004094750 | A1 | * | 11/2004 | E04B 9/061 |
| WO | WO-2007008094 | A1 | * | 1/2007 | E04F 19/061 |
| WO | WO-2010132909 | A1 | * | 11/2010 | A47B 96/067 |
| WO | WO-2014023620 | A1 | * | 2/2014 | E04F 13/045 |
| WO | WO-2019197168 | A1 | * | 10/2019 | E04F 13/06 |
| WO | WO-2019226960 | A1 | * | 11/2019 | E04F 19/0436 |
| WO | PCTUS2244677 | | | 9/2022 | |
| WO | WO-2023059464 | A1 | * | 4/2023 | E04F 13/0841 |
| WO | WO-2023183871 | A1 | * | 9/2023 | E04F 19/061 |

* cited by examiner

Fig. 17A
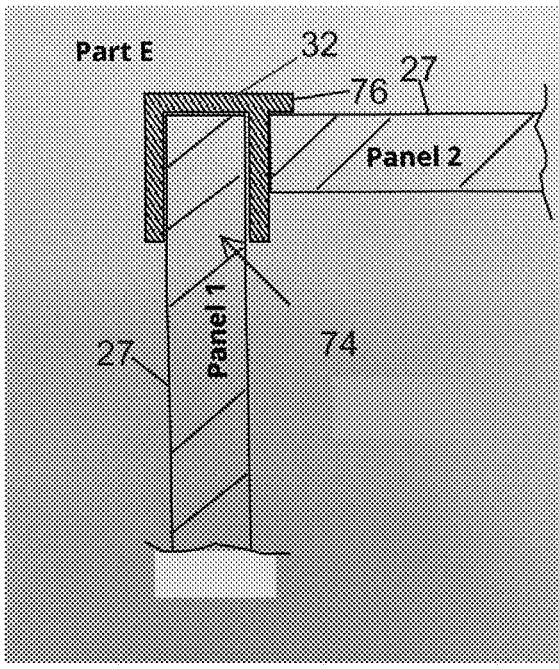
Fig. 17B
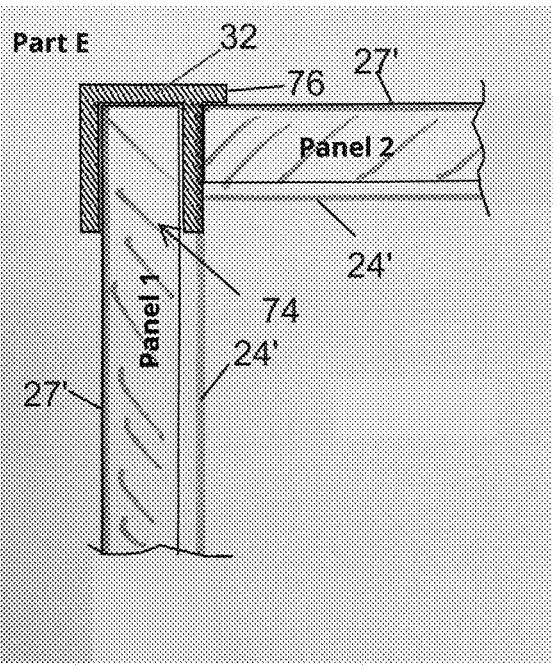
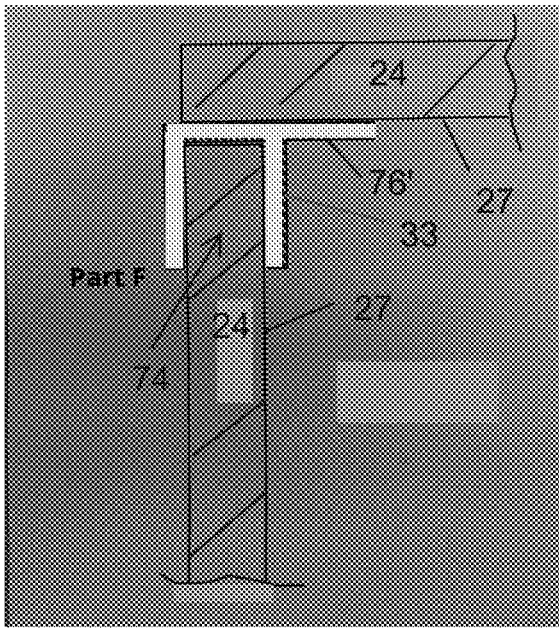
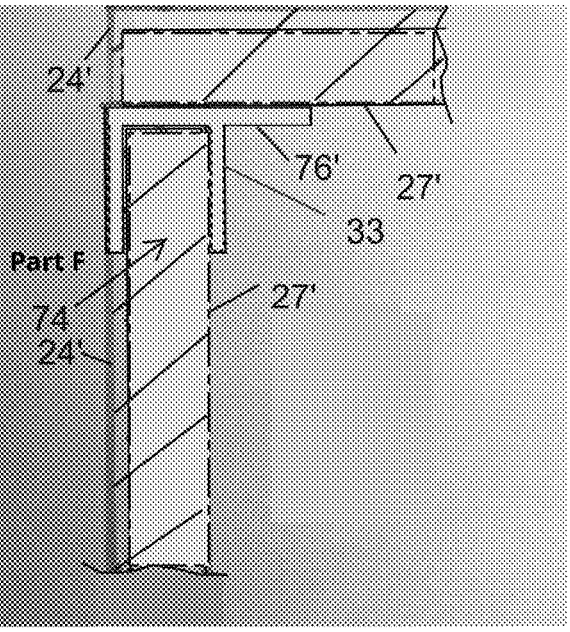
Fig. 18A
Fig. 18B

FLOOD RESISTANT WALL

TECHNICAL FIELD

This invention relates to a water-resistant prefabricated wall system that may be easily and conveniently installed onto existing wall studs. More particularly, the wall system of the present invention may be easily and conveniently removed from the wall studs and then reinstalled as desired, such as after exposure to flooding or the like, to permit the components to dry.

BACKGROUND INFORMATION

A common building method for residential and commercial buildings includes mounting drywall panels onto vertical (e.g., wood or aluminum) studs to create a closed wall. These drywall walls are then spackled and painted for a finished appearance.

The use of drywall panels has several advantages: they are relatively inexpensive, relatively lightweight (for transportation and mounting), they can be easily cut (knife or simple hand saw) and they can be easily "connected" with common, readily available, spackling/painting techniques for a finished look.

One disadvantage is that the drywall panels structurally disintegrate when exposed to excessive moisture or liquid water for instance in floods. Left alone to dry out, these panels are then prone to harbor dangerous mold and no longer have their original structural integrity. These problems are especially acute in basement installations, and in first-floor walls of homes in flood prone areas.

As recent rainstorms and hurricanes have shown, even the most "flood proof" basements and buildings are no longer secure from flooding. During the recent Ida hurricane, hundreds or thousands of basements in the Northeast were flooded in areas that were not traditionally floodprone. With the changing climate, more extreme weather patterns and more severe rain falls in short periods of times are already common. This trend is expected to continue and worsen.

Traditionally, finished basements and buildings that have been flooded have seen a bottom portion of their drywall cut out. This drywall was then replaced with new drywall, which was spackled and painted over. The entire process is costly, dirty and inconvenient. Most of all, the fact that the same material is used again, only to be damaged again in the next flood, creates a future problem.

A need exists for a wall system that addresses the foregoing issues.

SUMMARY

The appended claims may serve as a summary of the invention. Moreover, particular embodiments of the invention include a panel system that can be retrofitted into the walls of existing finished basements or buildings, or alternatively, used in newly installed basement/interior walls. These embodiments offer the following advantages:

Waterproof/water-resistant. Materials such as cement boards, PVC, etc., are used instead of sheetrock. Cement board, for example, may be exposed to wet conditions for extended periods of time and then dried without loss of structural integrity.

Spackle-less. Installations provide a finished appearance without the time and mess associated with spackling and sanding. Finished basements are often confined and full of furniture that is inconvenient to move. Avoiding the time and mess associated with sanding and spackling is particularly desirable in these applications.

Removable. When water gets in the basement/building, it gets everywhere . . . including behind walls and into insulation. Even if materials are waterproof (e.g., don't structurally disintegrate like drywall), they should thoroughly dry out in order to avoid dangerous mold growth. A panel system in which the panels are easily removed and replaced is advantageous.

Attractive. Since these embodiments are used in the interior of buildings (e.g., homes) and basements, it must be visually attractive to be adopted by the homeowner. The sharp and clean finish options, including wainscoting-reminiscent styles that the invention is advantageous.

Cost reduction. Flood-prone homes and basements may not flood just once, but repeatedly during the lifespan of a home. The resulting clean-up and renovation costs are burdensome to the property owner and also the government, due to frequently needed FEMA (U.S. Federal Emergency Management Agency) support. These embodiments tend to reduce future costs because the used parts can be re-used after a flood. Reducing the costs of wall rebuilds after each flood may be advantageous to the property owner and society.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which:

FIG. 17A is a cross-sectional view of a representative embodiment taken along 17-17 of FIG. 16;

FIG. 17B is a cross-sectional view of another representative embodiment taken along 17-17 of FIG. 16;

FIG. 18A is a cross-sectional view of a representative embodiment taken along 18-18 of FIG. 16;

FIG. 18B is a cross-sectional view of another representative embodiment taken along 18-18 of FIG. 16;

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

As used in the specification and in the appended claims, the singular forms "a", "an", and "the" include plural referents unless the context clearly indicates otherwise. For example, reference to "a panel" includes a plurality of such panels. In another example, reference to a "finishing strip" includes a plurality of such finishing strips.

Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

Turning now to the appended Figures, various embodiments will be described. In typical retro-fit applications, drywall has been removed from walls approximately 12-50 inches from floor. In typical new construction applications, drywall would be mounted to form upper wall portions, leaving studs exposed approximately 24" from the floor.

Figure 1:
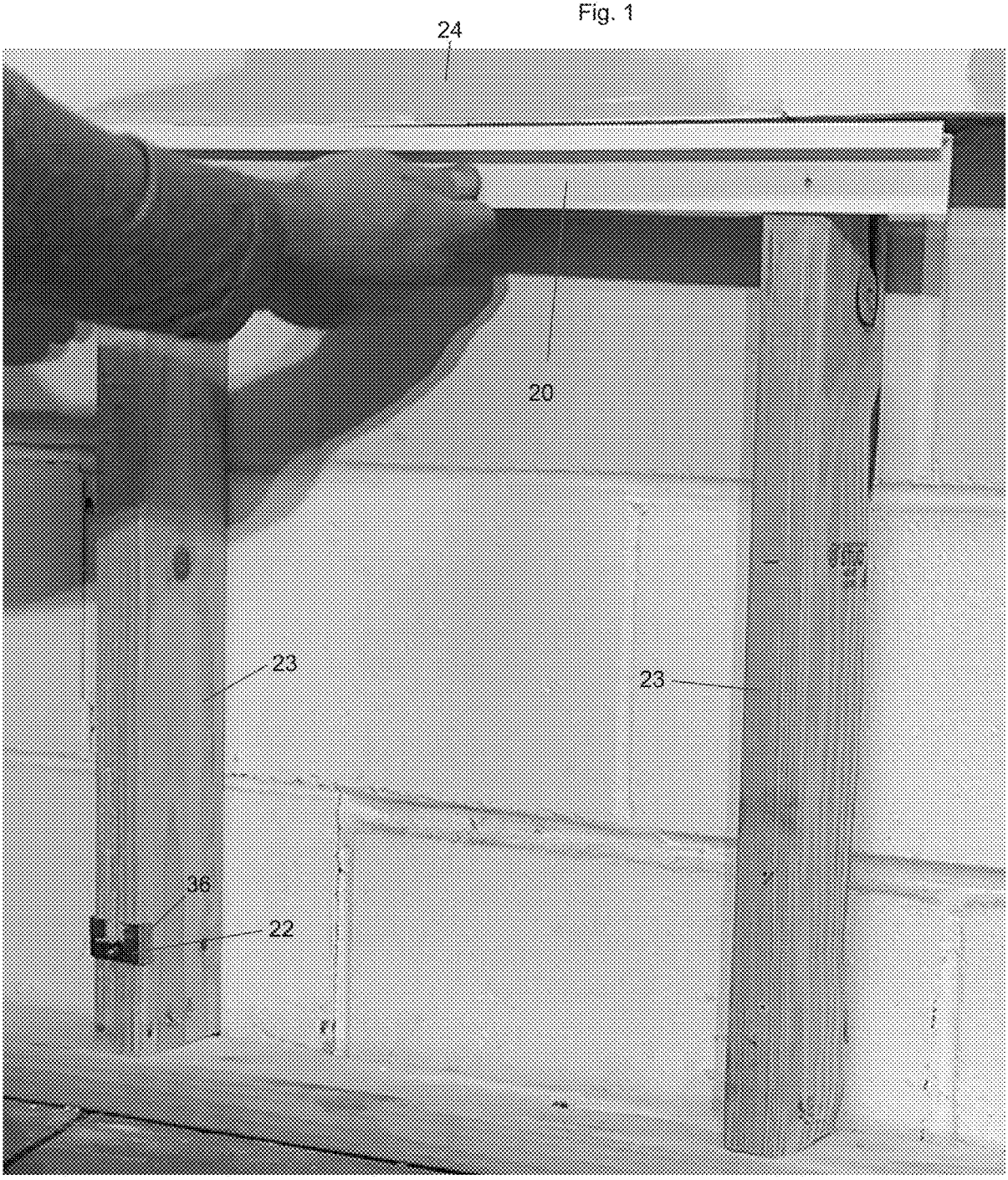
FIG. 1 is a perspective view of an aspect of an embodiment of the present invention during installation.
Figure 2:
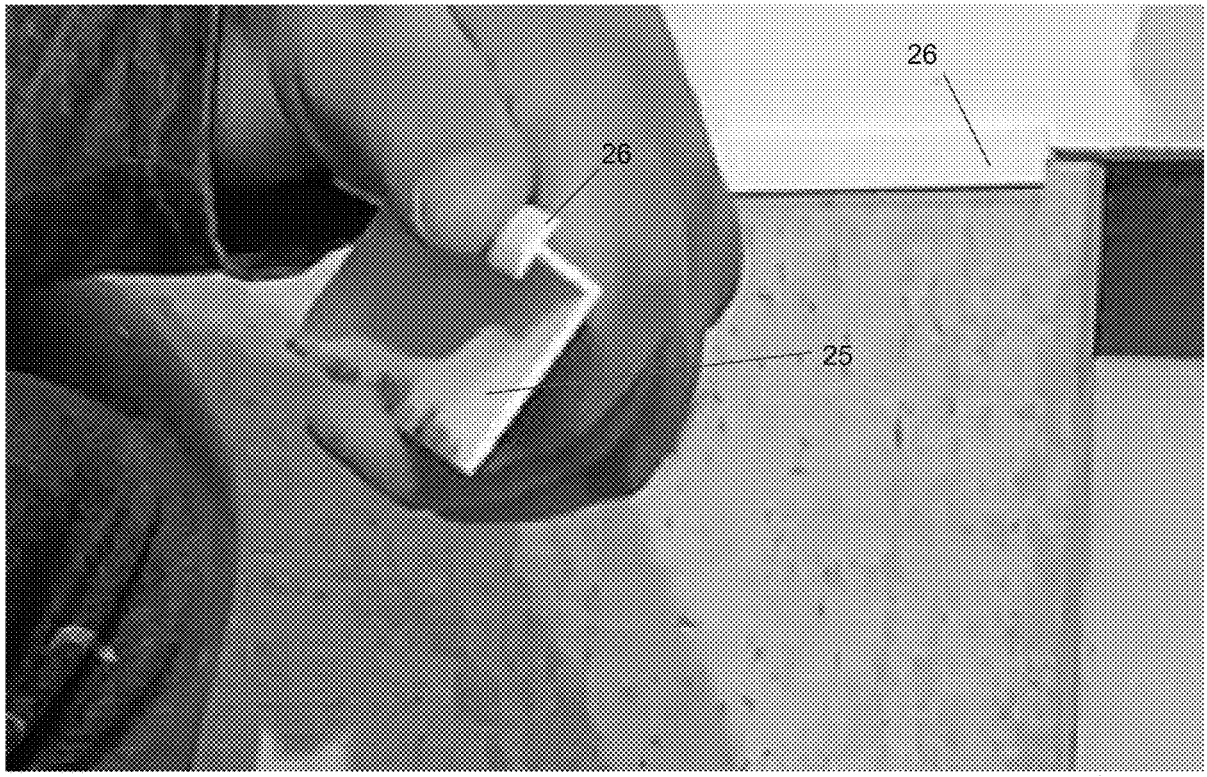
FIG. 2 is a perspective view of an aspect of an embodiment of the present invention during installation.

As shown in FIGS. 1-4, a finish molding strip ("finishing strip") 20 is mounted horizontally against studs 23 flush underneath drywall 24. As shown in FIG. 2, finishing strip 20 includes a backing flange 25 configured for fastening strip 20, e.g., with nails or screws or staples, to the studs 23, while an upper lip portion 26 reaches over the drywall to provide a finished edge.

Figure 3:
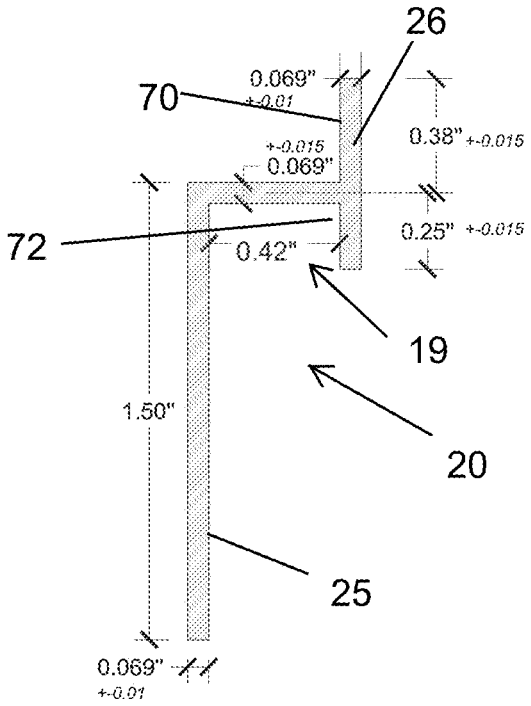
FIG. 3 is a side elevational view of a component of an embodiment of the present invention.
Figure 4:
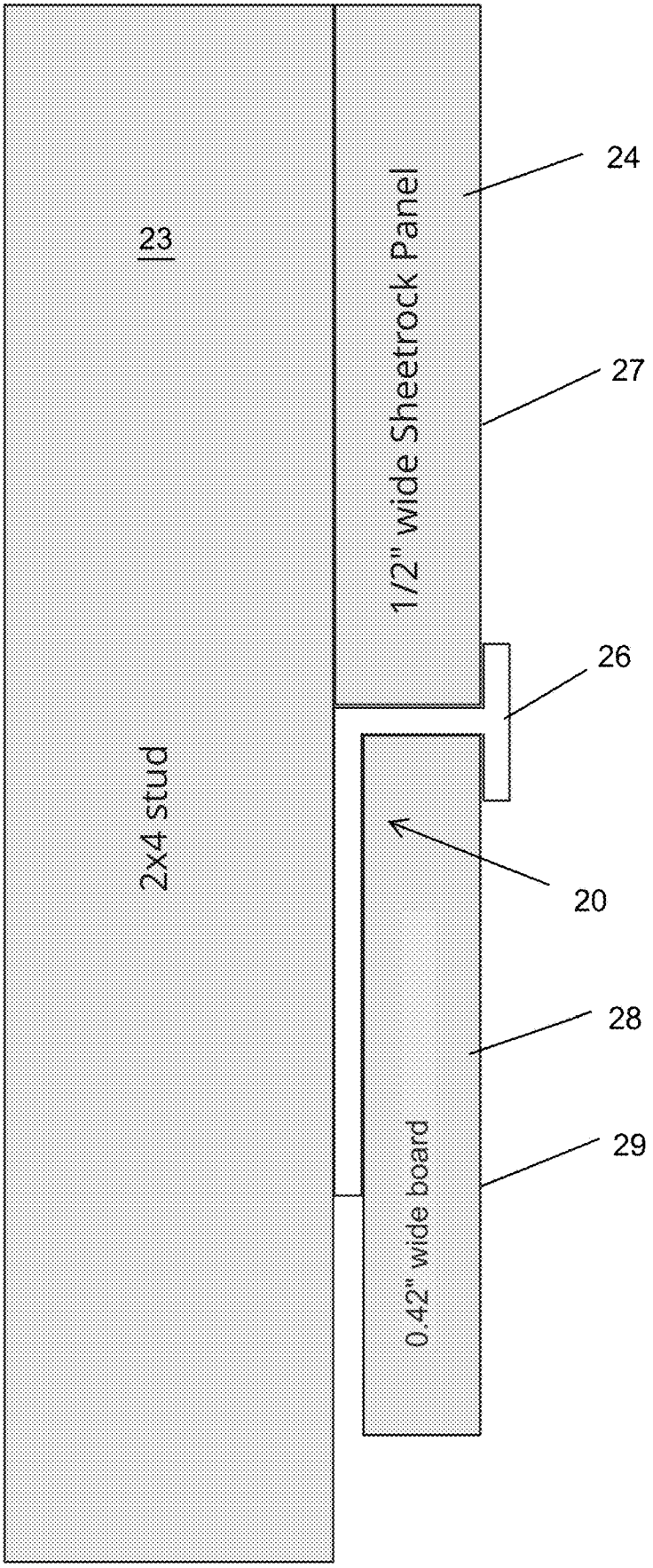
FIG. 4 is a side elevational view of an installation of various components of an embodiment of the present invention.

Turning to FIGS. 3 and 4, finishing strip 20 is sized and shaped for use with a conventional 0.5 inch (½") thick drywall board. As shown, backing flange 25 and lip portion 26 form a receptacle 19 configured as an inverted U sized and shaped to slidably receive an upper edge portion of one of the cement board 24 (FIG. 4) therein. As best shown in FIG. 4, finishing strip 20 effectively maintains a conventional cement board 28, having a thickness of 0.42", in spaced relation with stud 23, so that the room-facing surfaces 27 and 29 of drywall board 24 and cement board 28, respectively, are maintained flush with one another. Lip portion 26 includes opposing flanges 70, 72 (FIG. 3) configured for superposed engagement with adjacent portions of the room-facing surfaces 27, 29 (FIG. 4). Thus, in this embodiment, the backing flange 25 provides the multiple benefits of (1) having a thickness that fills the gap between the thickness of the cement board 28 relative to that of the drywall board 24, to ensure they're flush with another as described hereinabove, (2) effectively finishing the interface between the cement board 28 and drywall board 24, and (2) enabling the strip 20 to be conveniently and efficiently secured to stud 23, e.g., with staples, brads, screws, etc. Indeed, in particular embodiments finishing strip is economically fabricated by PVC extrusion, which is then easily secured to stud 23 with staples.

Figure 5:
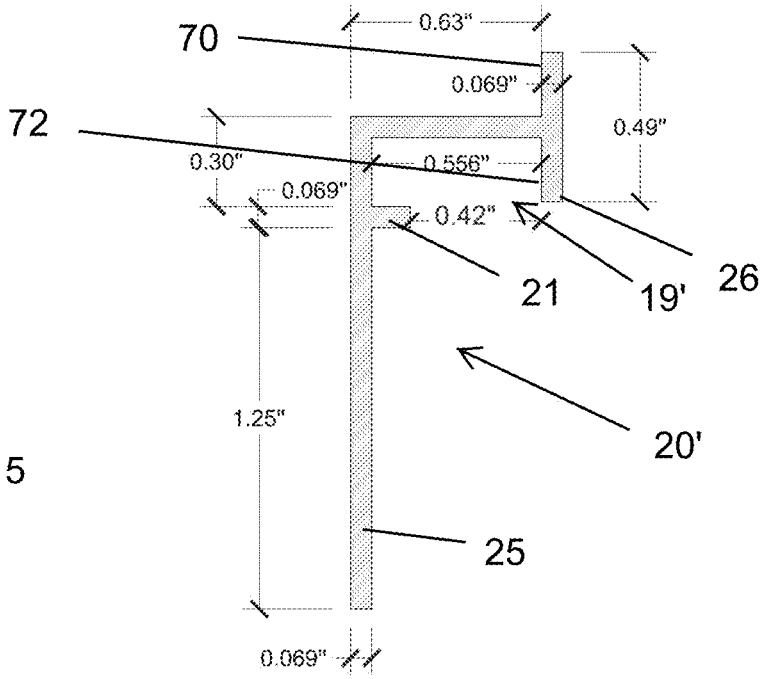
FIG. 5 is a view similar to that of FIG. 3, of an alternate embodiment of the present invention.
Figure 6:
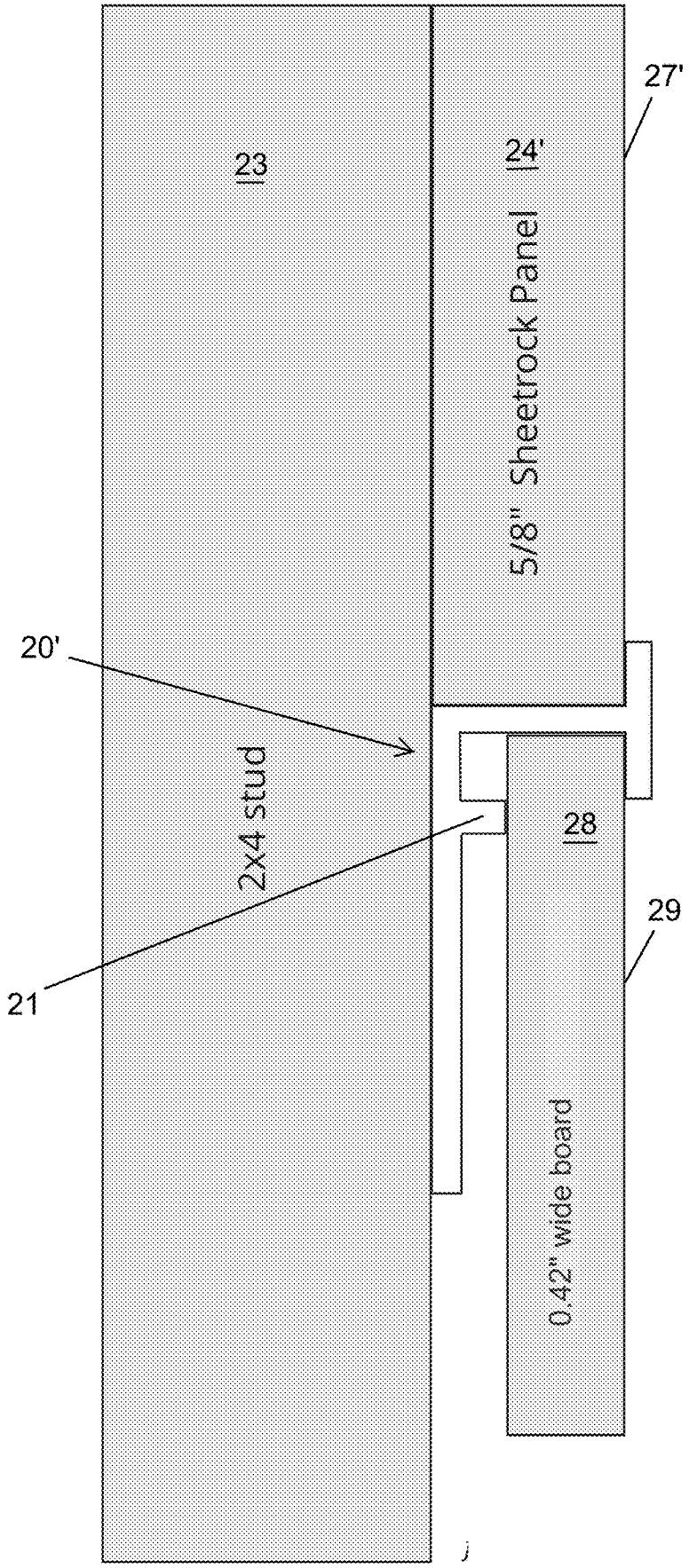
FIG. 6 is a view similar to that of FIG. 4, of an alternate embodiment of the present invention.
Figure 7A:
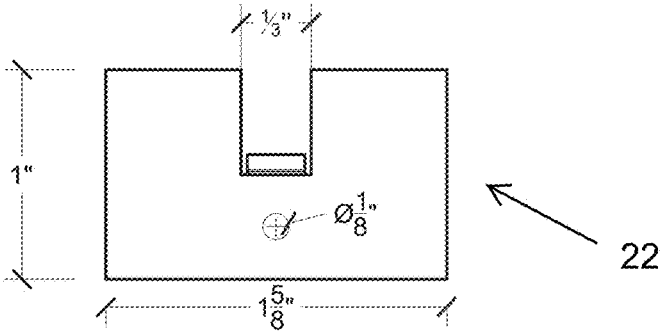
FIG. 7A is a front elevational view of a component of an embodiment of the present invention.
Figure 7B:
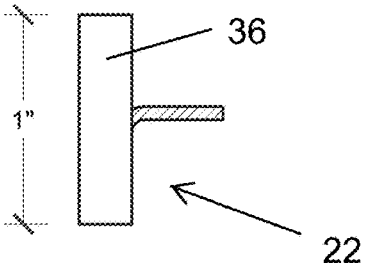
FIG. 7B is a side elevational view of the component of FIG. 7A.
Figure 7C:
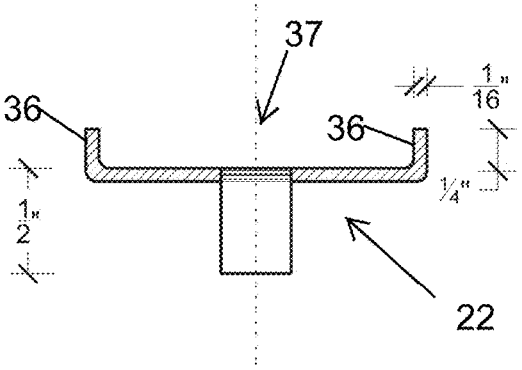
FIG. 7C is a top plan view of the component of FIGS. 7A, 7B.

Turning to FIGS. 5 and 6, in an alternate embodiment of finishing strip is shown at 20', is substantially similar to finishing strip 20 but for being sized and shaped for use with a thicker, e.g., 0.625 inch (⅝"), drywall board shown at 24'. As shown, backing flange 25 and lip portion 26 form a receptacle 19' configured as an inverted U sized and shaped to slidably receive an upper edge portion of one of the cement board 24 (FIG. 6) therein. In the embodiment shown, the extra thickness of drywall board 24' relative to board 24 (FIG. 4), is accommodated by providing finishing strip 20' with an integral spacer/offset 21 that serves to maintain the 0.42" thick cement board 28 further from stud 23 so that the room-facing surfaces 27' and 29 of drywall board 24' and cement board 28 and are maintained flush with one another as shown. Lip portion 26 includes opposing flanges 70, 72 (FIG. 5) configured for superposed engagement with adjacent portions of the room-facing surfaces 27', 29 (FIG. 6). Advantageously, provision of finishing strips 20, 20' enable the same 0.42" cement boards 28 to be used with either ½" or ⅝" drywall.

As shown in FIGS. 1 and 7A-7C, mounting clips 22 are configured with side flanges 36 sized and shaped for effectively wrapping around studs 23 (FIG. 1), e.g., to effectively form a receptacle 37 sized and shaped for receiving a stud therein. As also shown, each clip 22 includes a transverse flange 38 that extends substantially orthogonally to side flanges 36. The clip 22 is configured for being secured to a stud 23, e.g., with screws, so that transverse flange 38 extends transversely from the room-facing surface of stud 23 to support a lower end of panel (e.g., cement board) 28 as shown in FIG. 9.

Figure 8:
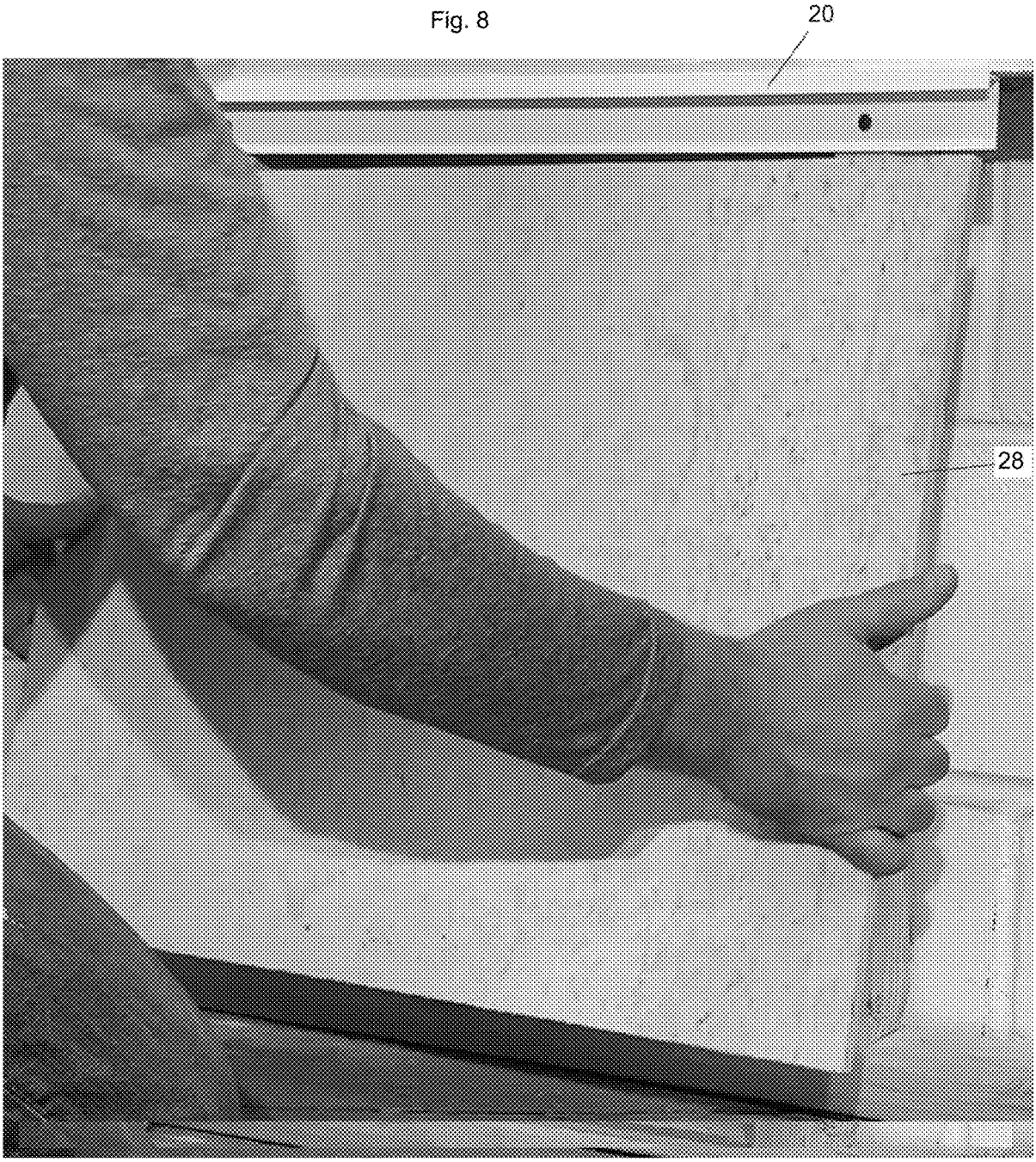
FIG. 8 is a view similar to that of FIG. 1, of additional aspects of an embodiment of the present invention.
Figure 9:
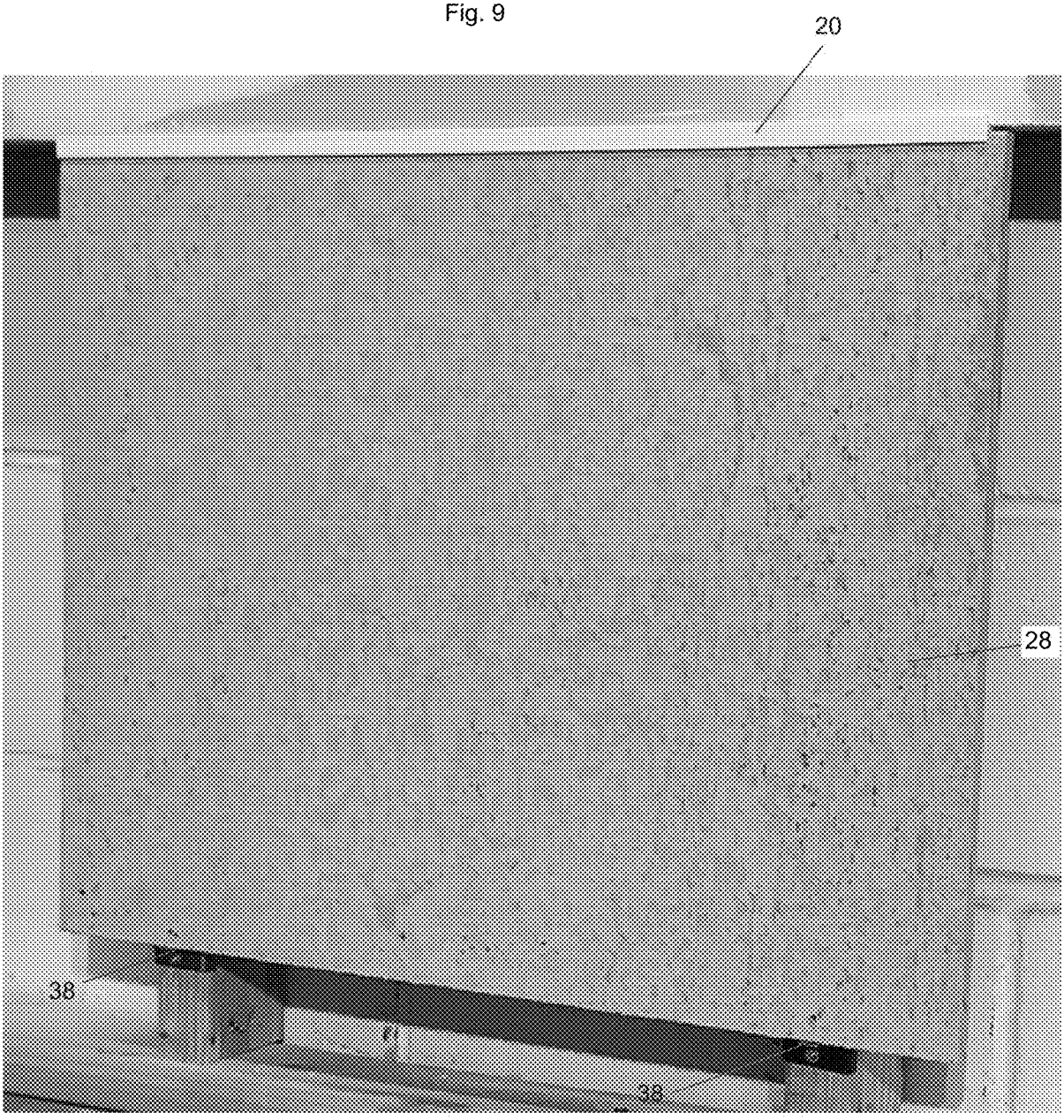
FIG. 9 is a view similar to that of FIG. 1, of additional aspects of an embodiment of the present invention.

Turning to FIGS. 8 and 9, in particular embodiments, panel 28 is approximately 21" high (leaving approximately 3" of free space between the bottom of the panel 28 and the floor in a typical installation in which the lower 24 inches of drywall has been removed due to water damage, etc., as described hereinabove). (As mentioned hereinabove, more or less of the lower drywall may have been removed, e.g., ranging from about 12-50 inches from floor in many instances.) Panel 28 is inserted between the backing flange 25 and lip portion 26 of an installed finishing strip 20, 20' (e.g., FIG. 8), and in supported engagement with flange 38 of mounting clips 22 (FIG. 9). It should be noted that in various embodiments, the mounting clips 22 are installed after panel 28 is inserted into the installed finishing strip 20, 20'. A helper may hold the panel in position as shown in FIG. 9, while the installer secures clips 22 to the studs as shown. Alternatively, a jack or similar tool may be used to hold the panel in position while clips 22 are secured to the stud.

Figure 10A:
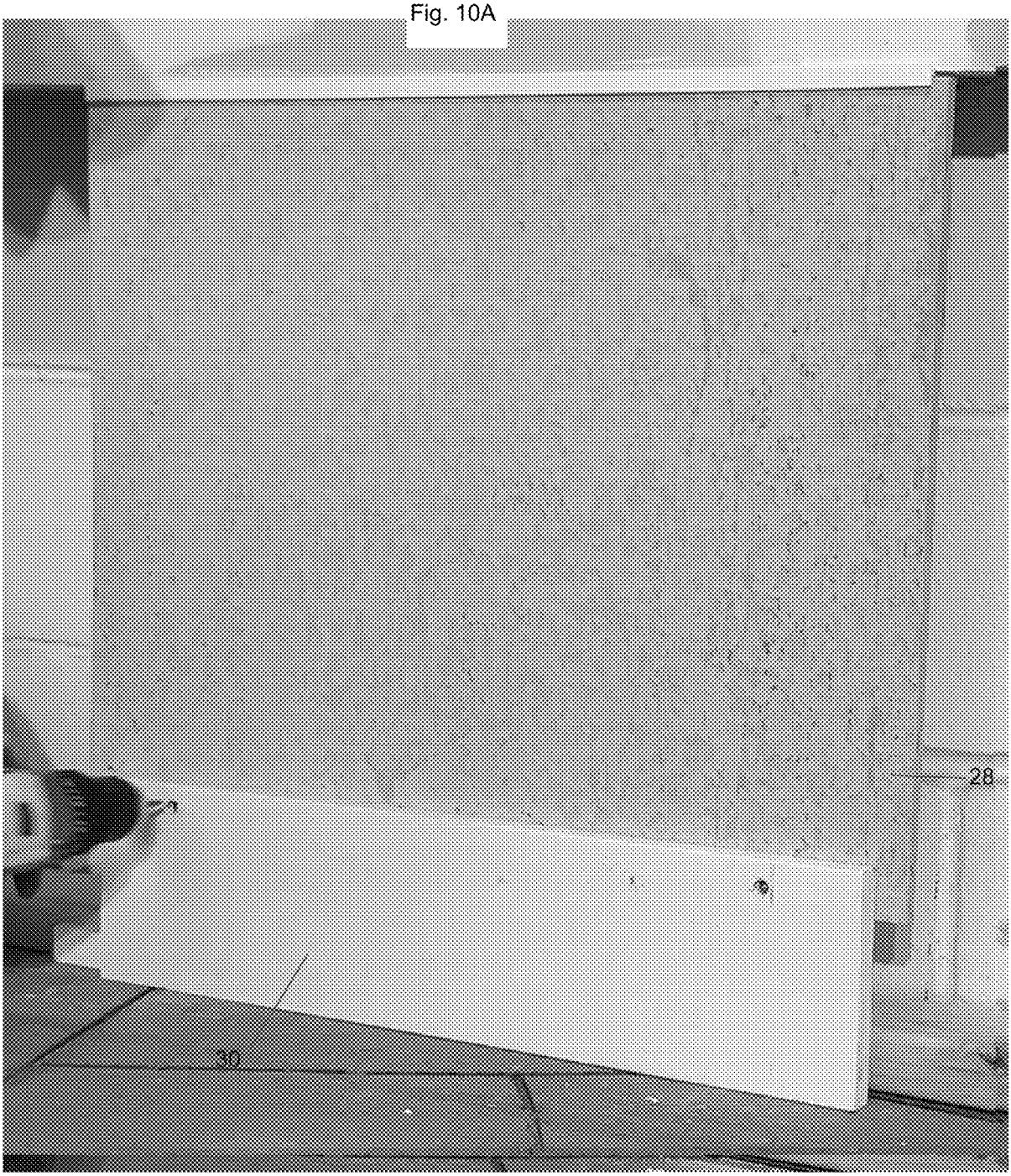
FIG. 10A is a view similar to that of FIG. 9, of additional aspects of an embodiment of the present invention.

As shown in FIG. 10A, a waterproof molding strip ("baseboard") 30, is secured to a lowermost portion of panel 28. In particular embodiments, baseboard 30 is approximately 4" to 5½" high, is fabricated from PVC or other plastic material, and is secured to panel 28 using decorative, countersunk screws running through panel 28 into studs 23. The skilled artisan will recognize that the use of countersunk screws facilitates convenient removal of the baseboard 30, and of panel 28, such as to dry out the wall and replace insulation, etc., in the event of a future incursion of water into the premises.

Figure 10B:
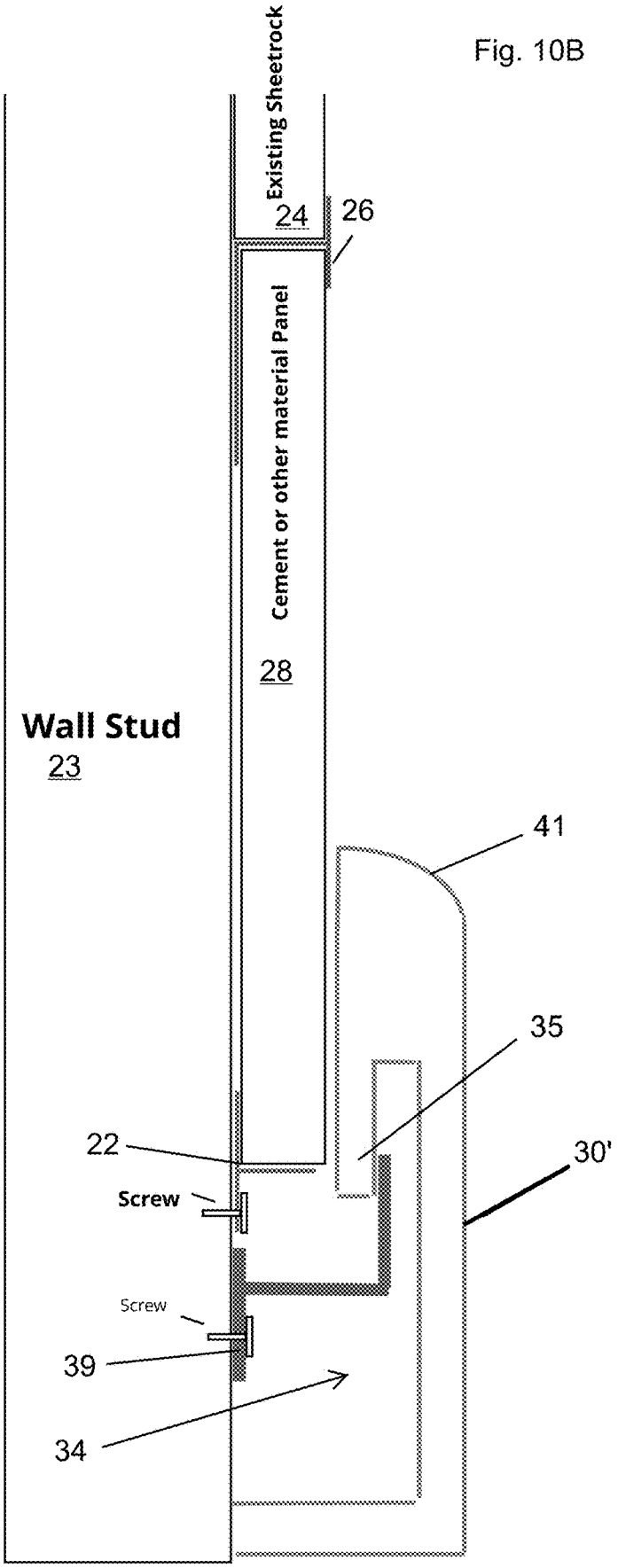
FIG. 10B is a cross-sectional schematic view of alternate embodiments of aspects of the present invention.

As shown in FIG. 10B, in an alternate embodiment, a baseboard 30' is configured with a concave (hollowed out) rear-facing surface 34, e.g., with a hook portion 35 configured for engaging a clip 39 fastened to stud(s) 23, for a substantially 'snap-on' assembly. Baseboard 30' may also include a decorative curved upper surface such as shown at 41. The use of concave surface 34 generally permits baseboard 30' to be fabricated from less material than an otherwise similar component without the concave surface. This concave configuration may thus provide for relatively low material cost and/or permit the use of relatively low cost fabrication approaches, such as extrusion.

Variations of this embodiment may be provided without hook portion 35, and fastened to the studs in a conventional manner, such as with screws (not shown). And although clip 39 is shown separately and distinctly from clip 22, those skilled in the art will recognize that clips 22 and 39 may be integrated into a single component without departing from the scope of the present invention.

Figure 11:
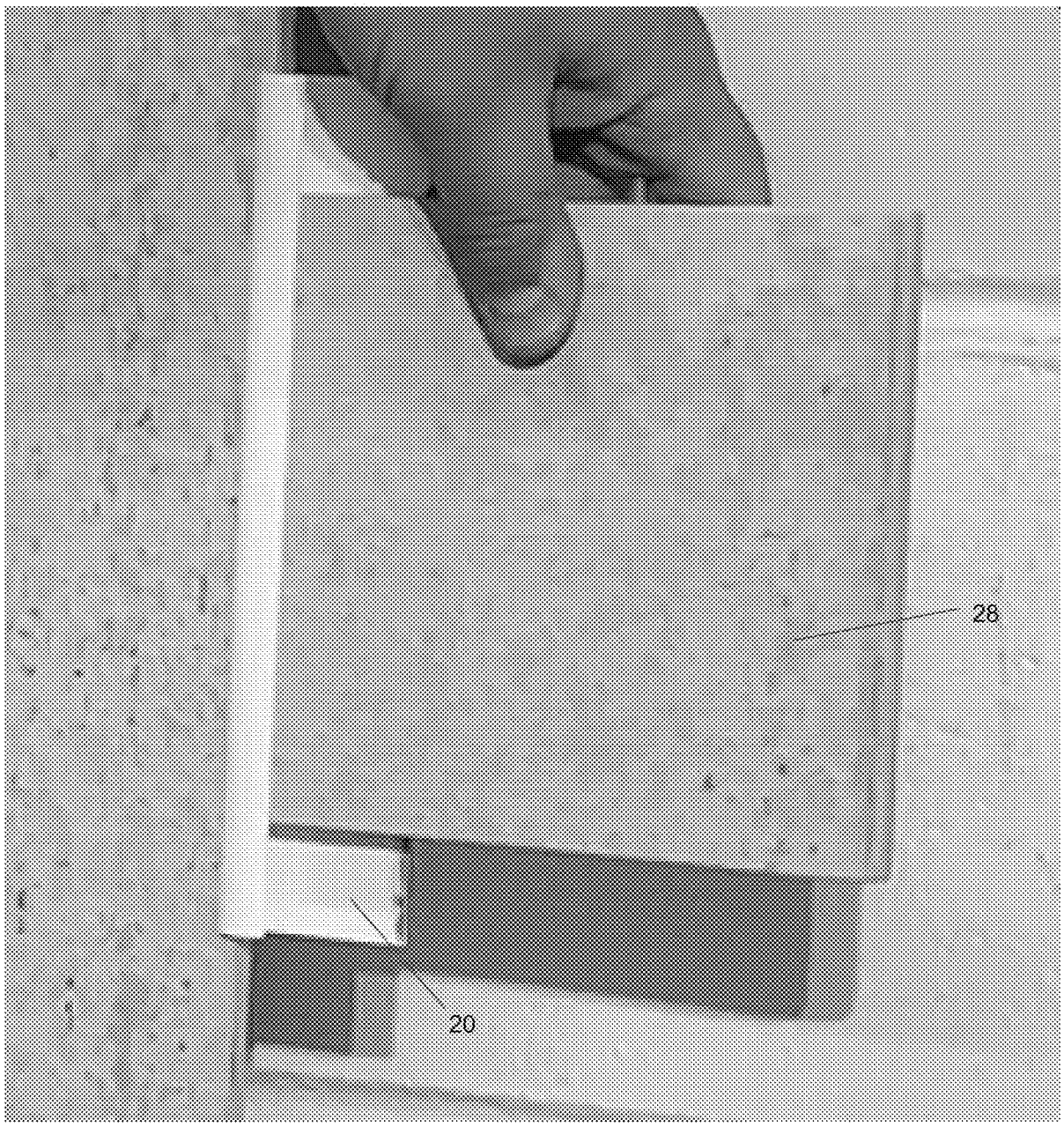
FIG. 11 is a view similar to that of FIG. 10, of additional aspects of an embodiment of the present invention.

Turning now to FIG. 11, vertical edges of adjacent panels 28 may be connected to one another using the aforementioned finishing strip 20 mounted vertically as shown, instead of horizontally. (Adjacent boards 28 are typically the same size, though a smaller board is shown for clarity.) It should be noted that this vertically mounted finishing strip 20 may be effectively captured between adjacent panels 28 as shown, to avoid the need to secure the strip to studs 23. This aspect tends to simplify installation since it is not necessary to ensure that vertical edges of panels 28 align with the studs.

Figure 12:
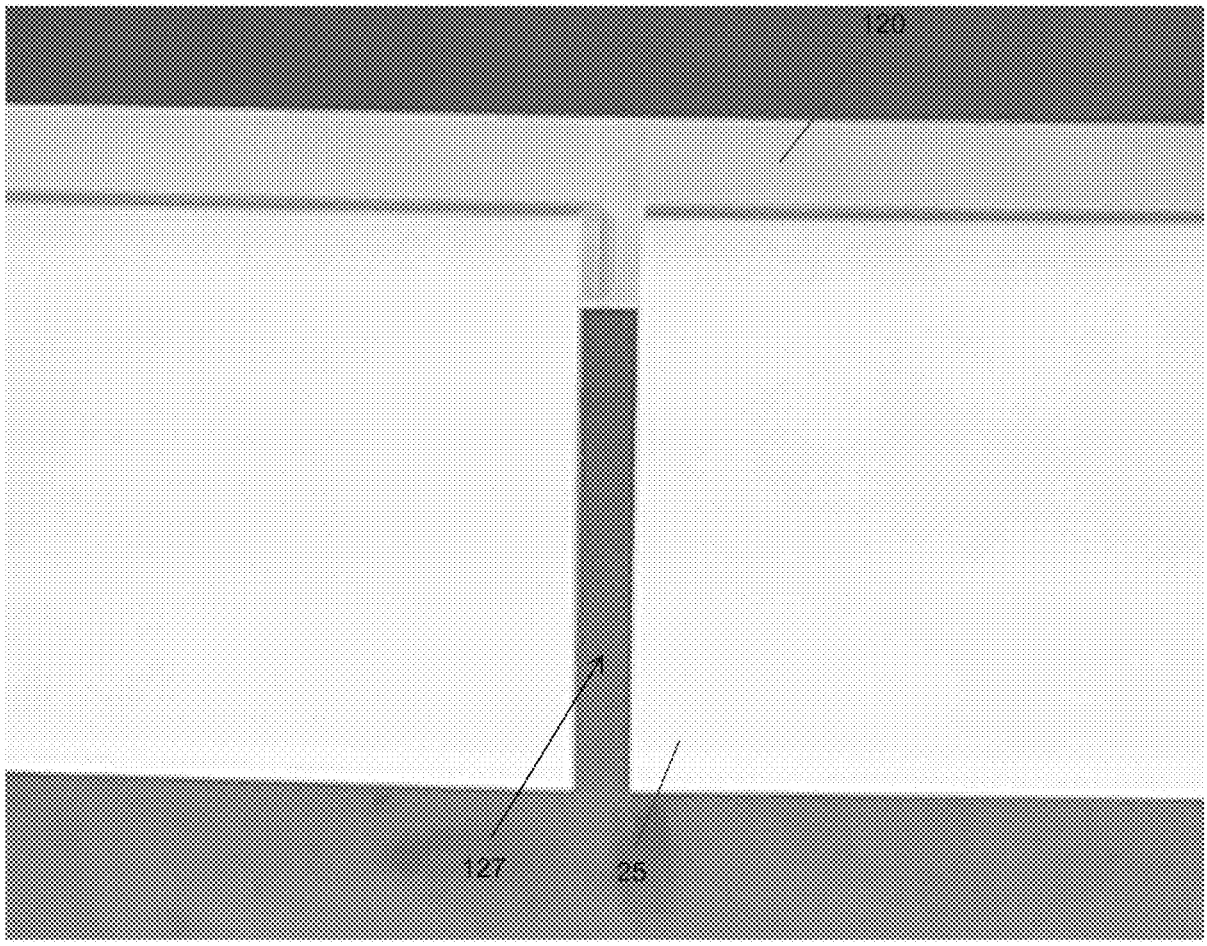
FIG. 12 is a back elevational view of a component of an embodiment of the present invention.
Figure 13:
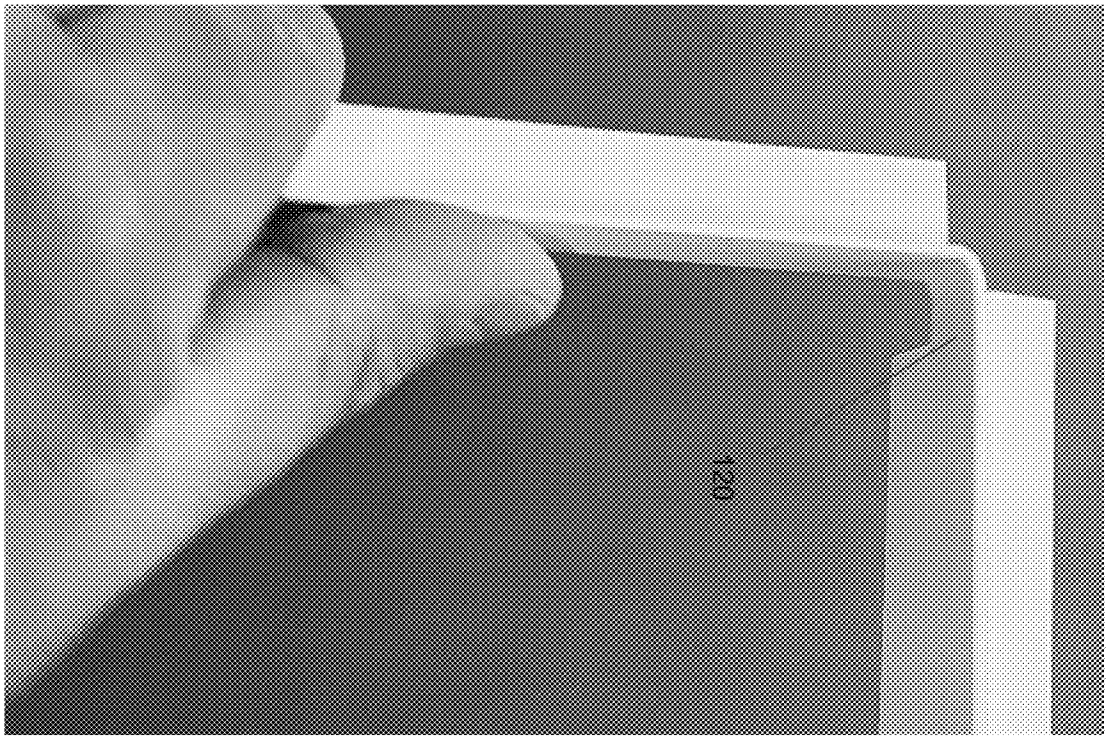
FIG. 13 is a top perspective view of the component of FIG. 12, during a step in the use thereof.
Figure 14:
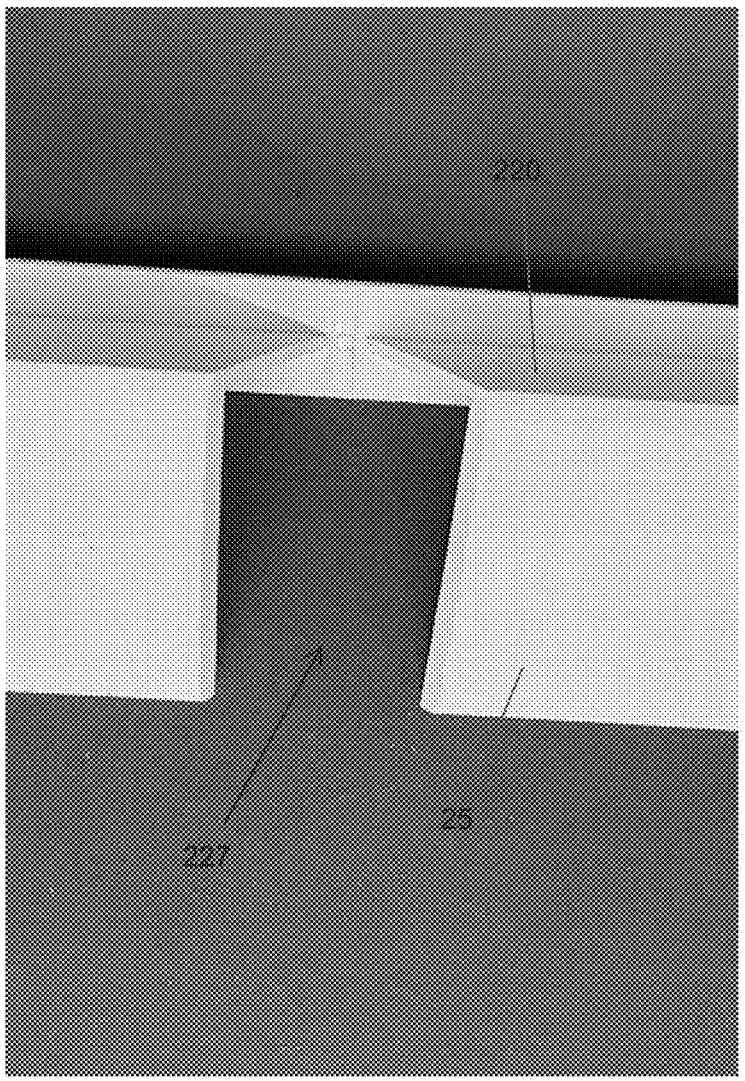
FIG. 14 is a view similar to that of FIG. 12, of another component of an embodiment of the present invention.
Figure 15:
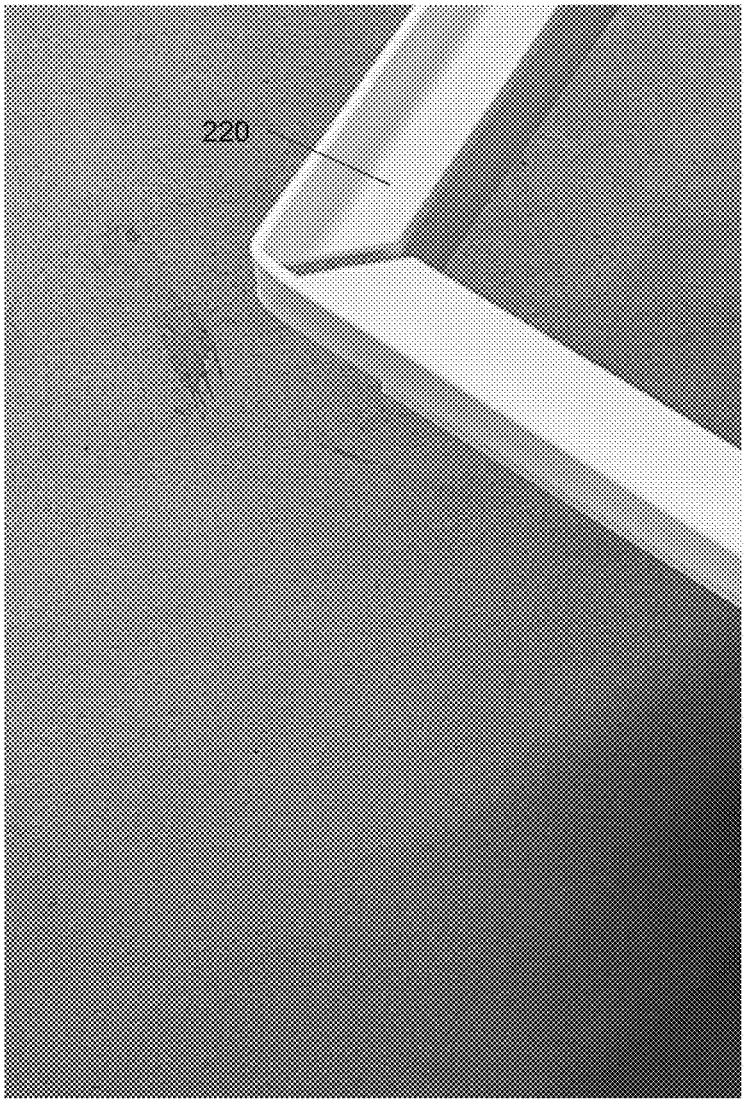
FIG. 15 is a view similar to that of FIG. 13, of the component of FIG. 14.
Figure 16:
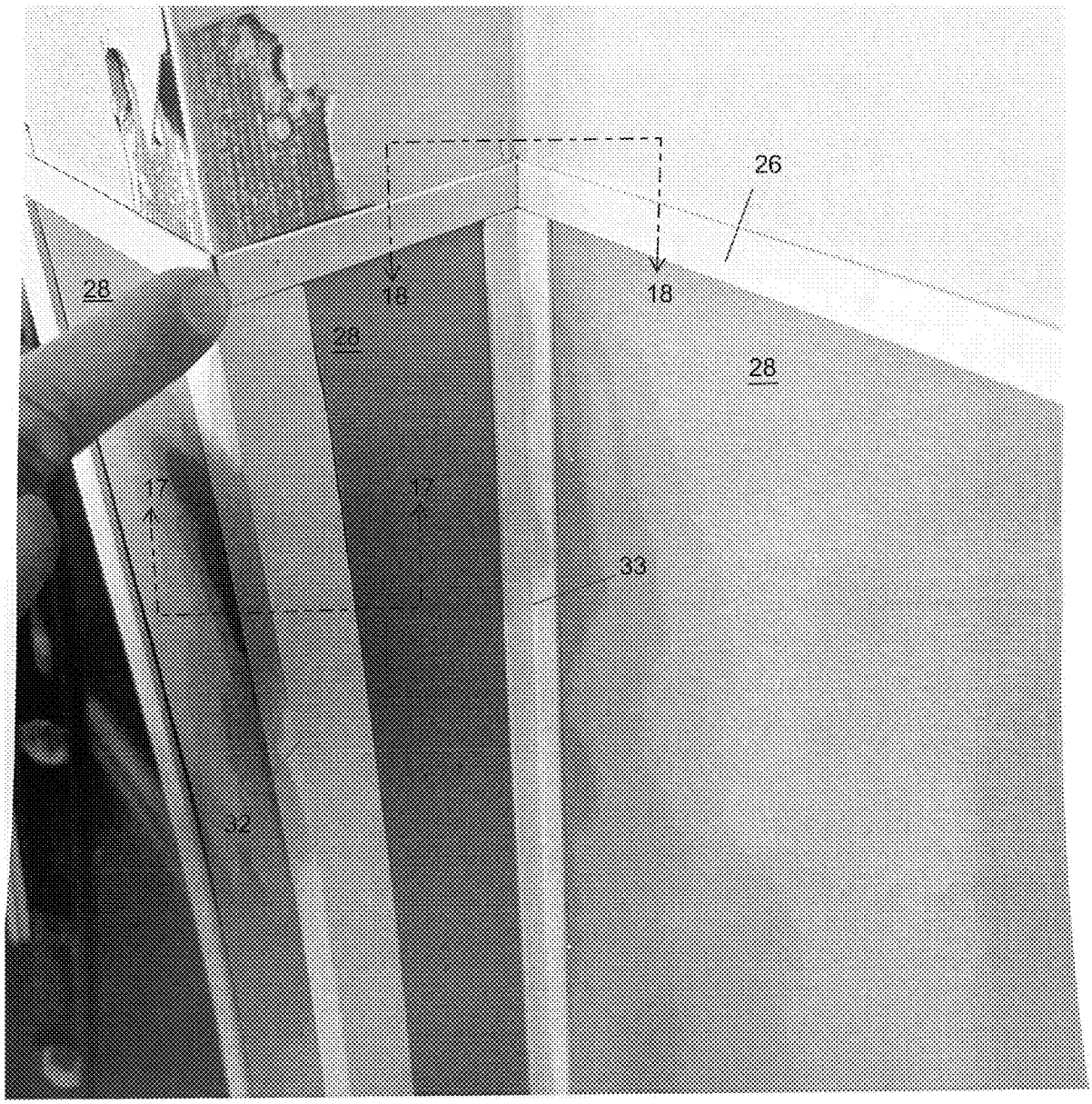
FIG. 16 is a perspective view of an exemplary installation of various components of embodiments of the present invention.
Figure 19:
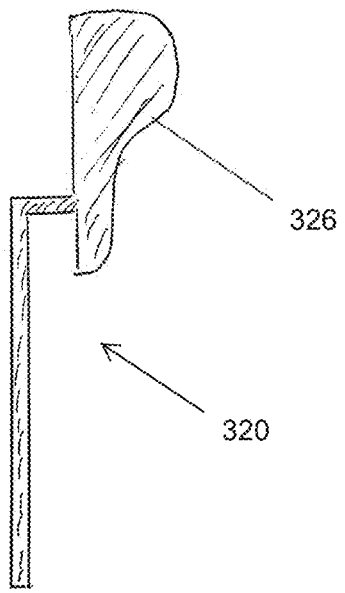
FIG. 19 is a cross-sectional view of a component of embodiments of the present invention.

As shown in FIGS. 12-15, modified versions of finishing strip 20 are configured for inside and outside corners, as shown as corner strips 120 and 220, respectively. In particular embodiments, these corner strips are formed by cutting in the field. Alternatively, they may be pre-formed, e.g., as part of the manufacturing process. As shown in FIG. 12, inside corner strip 120 is formed by cutting a slot 127 into the backing flange 25 of a finishing strip 20 and bending it as shown in FIG. 13 for use in an inside corner. Similarly, as shown in FIG. 14, outside corner strip 220 is formed by cutting a slot 227 into the backing flange 25 of a finishing strip 20 and bending it as shown in FIG. 15 for use in an outside corner. Once bent as shown, the backing flanges 25 of corner strips 120, 220 may be secured to studs and used as shown and described hereinabove to secure panels 28, to form inside and outside corners, respectively. In such a configuration, the upper lip portion 26 of the corner strips provides a clean finished look, e.g., as shown in FIG. 16.

Referring now to FIGS. 16-18B, in various embodiments, corner strips 32 and 33 are used to connect vertical edges of adjacent boards 28 to form outside and inside corners, respectively. As shown in FIGS. 17A-18B, corner strips 32 and 33 are configured to be effectively universal-fit, i.e., usable independently of the thickness of drywall panels 24, 24', to advantageously reduce the number of separate SKUs in a typical installation.

Turning to FIGS. 17A-18B, this universality is provided by sizing and shaping corner strips 32 and 33 with an F-shaped cross-section forming a vertical receptacle 74 to slidably receive a side edge portion of a cement panel 28 therein, and a vertical flange portion 76, 76' configured for being superposed with the room-facing surface 27, 27' of an adjacent one of said plurality of panels, as shown. The corner strips 32, 33, like the vertical edge strips, are held in position by the panels 28, without any need for being secured to the studs 23. And as discussed hereinabove, the finishing strips 20, 20' (as well as corner strips 120, 220) maintain room facing surfaces 29 of panels 28 in flush orientation with the room-facing surfaces 27, 27' of either ½" or ⅝" drywall. Since the corner strips 32, 33 are supported by the panels 28 beneath the finishing/corner strips without any contact with the drywall 27, 27', as shown in FIG. 16, the corner strips 32 and 33 are necessarily maintained in proper orientation with the room-facing surfaces of the drywall regardless of the drywall thickness. The skilled artisan should recognize that although embodiments of the present invention have been shown and described with respect to either ½" or ⅝" drywall and 0.42" cement panels, substantially any thickness of drywall/panels may be used without departing from the scope of the invention.

Once installed as shown, panels 28 may be painted. In particular embodiments, strips 20, 20', 120, 220, 32, 33, are covered with a protective tape to protect their room-facing portions from being painted over. After the painting is finished, the protective tape may be removed to produce a clean, finished edge. Alternatively, the panels 28 may be pre-painted, i.e., painted prior to installation, which tends to facilitate fast installations. The modularity of the instant embodiments, including the lack of any need for the aforementioned spackling, etc., advantageously permits such pre-painting.

Turning now to FIGS. 19-25, alternate embodiments of the present invention provide a wainscoting effect. As shown, particular embodiments include a finishing strip 320 that is substantially identical to finishing strip 20 but for a modified upper lip portion 26' having a chair rail portion 326 as shown in transverse cross-section in FIG. 19. It should be noted that chair rail portion 326 may be provided with any number of profiles configured to form any number of styles of chair rail.

Figure 20:
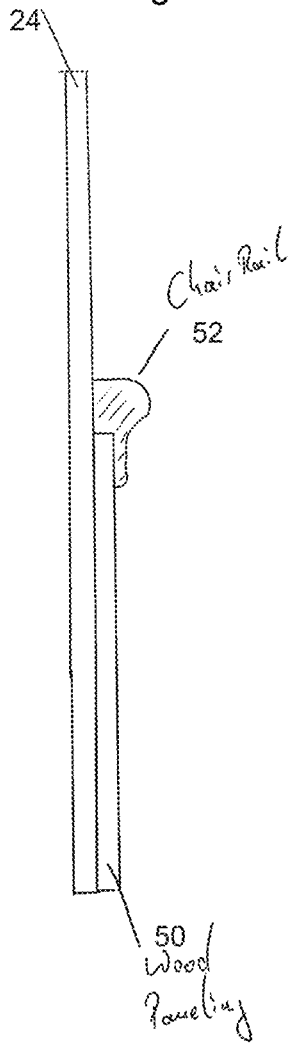
Fig. 20 Prior Art
FIG. 20 is a side-view of aspects of the prior art.
Figure 21:
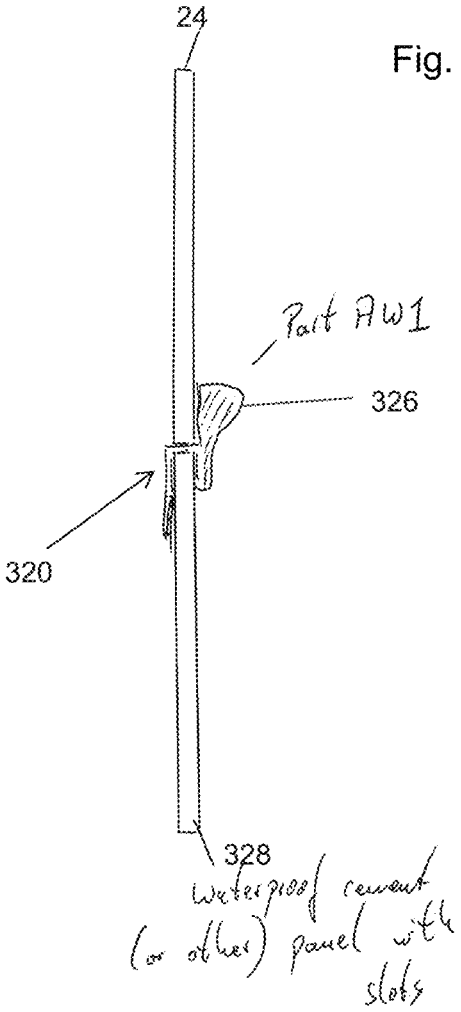
FIG. 21 is a view similar to that of FIG. 20, of aspects of embodiments of the present invention.
Figure 22:
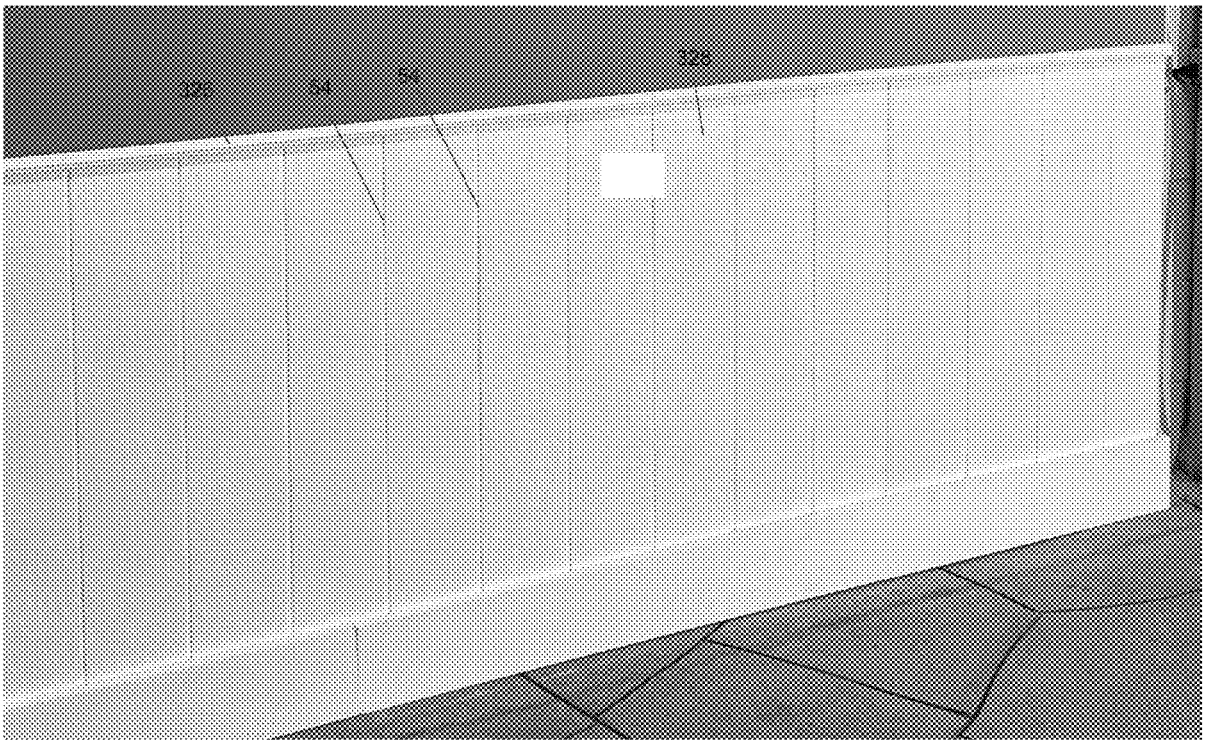
FIG. 22 is a perspective view of an installation of an embodiment of the present invention.
Figure 23:
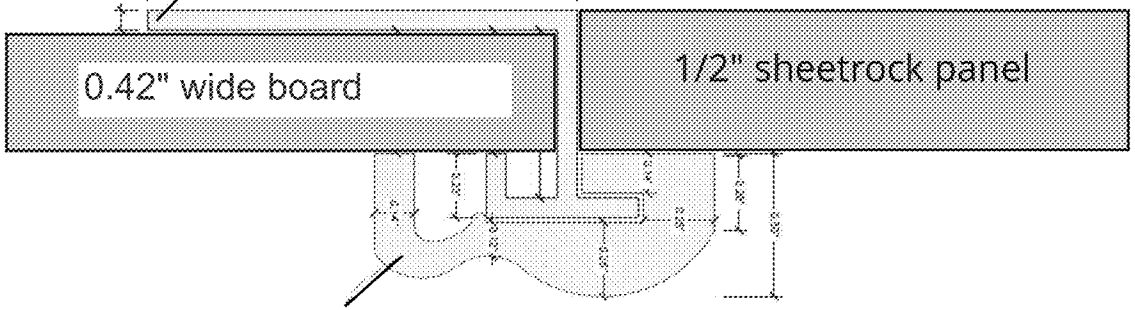
FIG. 23 is a view similar to that of FIG. 21, of an alternate embodiment of the present invention.
Figure 24:
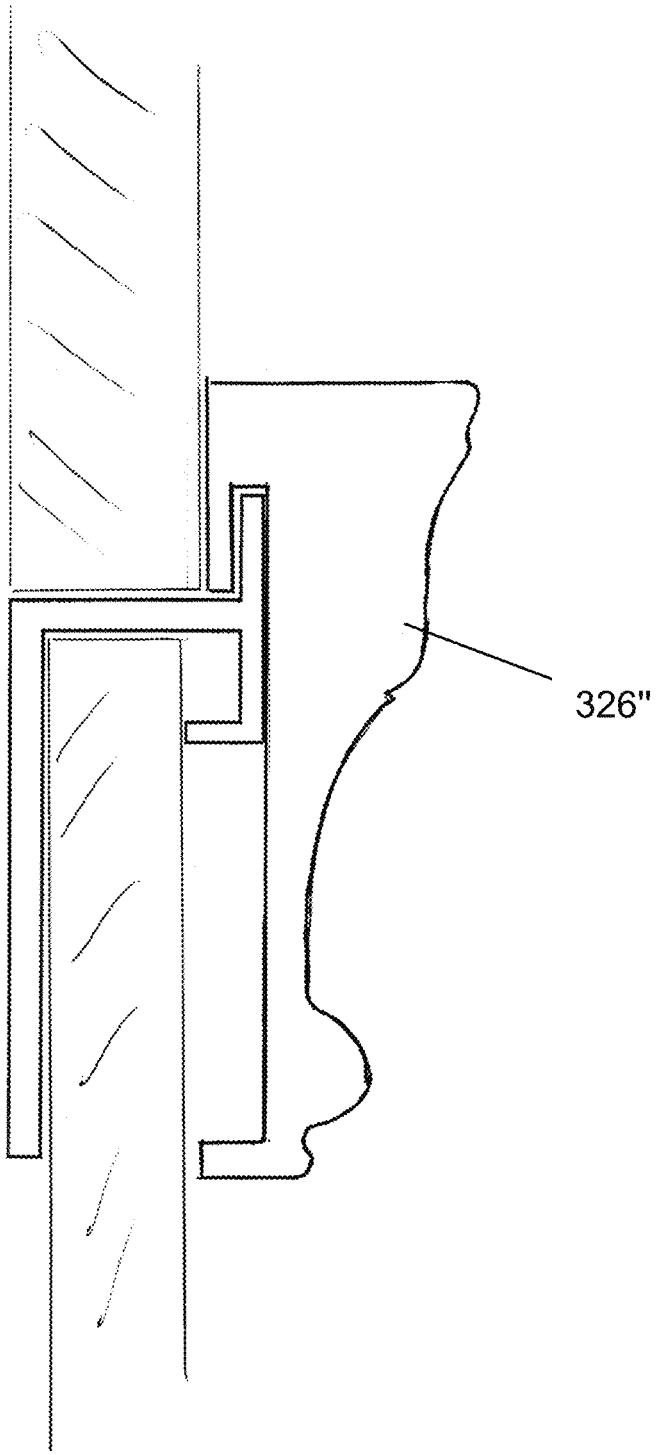
FIG. 24 is a view similar to that of FIG. 21, of an alternate embodiment of the present invention.
Figure 25:
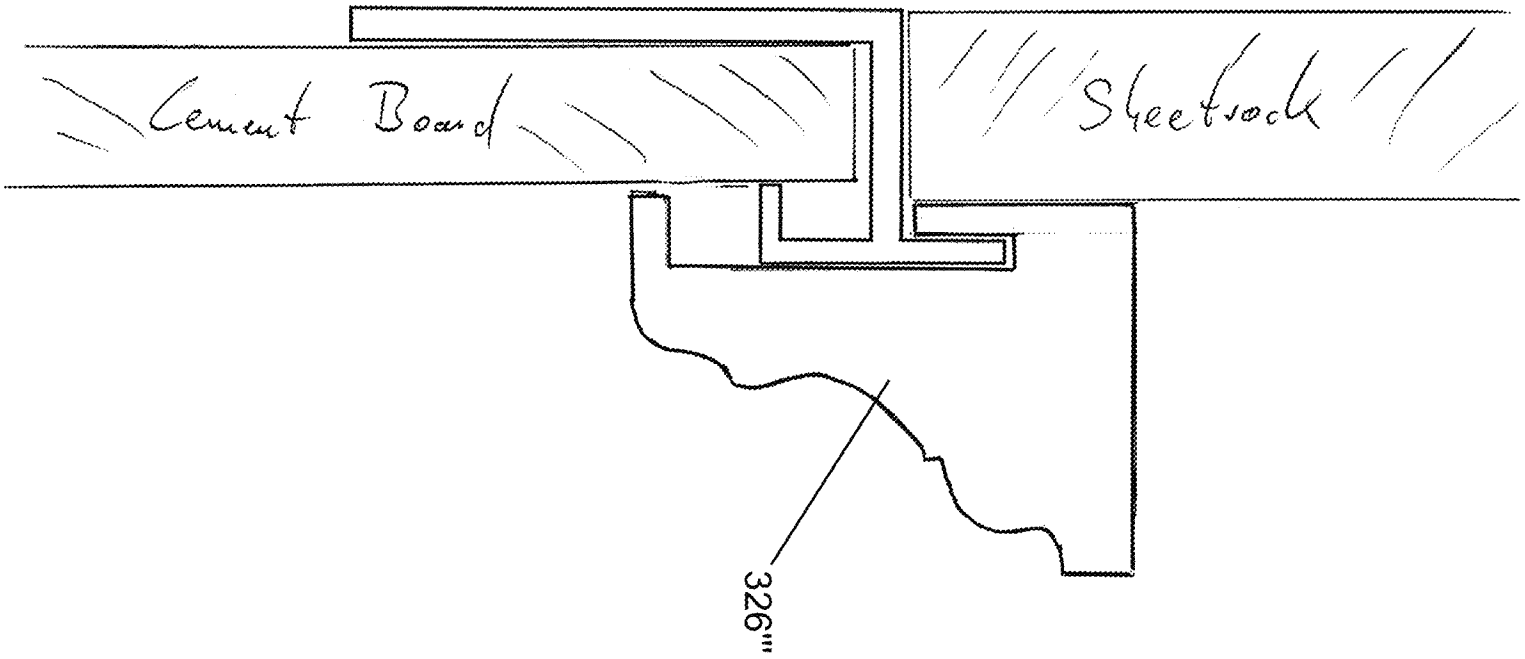
FIG. 25 is a view similar to that of FIG. 21, of an alternate embodiment of the present invention.

Turning now to FIG. 20-22, aspects of these embodiments and differences relative to conventional wainscoting are described. As shown in FIG. 20, conventional wainscoting typically includes wood paneling 50 applied to a lower wall portion of drywall 24. An upper portion of the wood paneling 50 is finished with chair rail 52 as shown. In contrast, as shown in FIGS. 21-22, embodiments of the present invention include a panel 28 modified with a series of parallel channels or kerfs 54 (e.g., using a conventional saw or similar means) to provide a wainscoting panel 328 (FIG. 21). The wainscoting panel 328 is installed as shown and described hereinabove with respect to panel 28, including the use of vertical finishing strips 20 (FIG. 11), though using finishing strip 320 with a chair-rail portion 326 at the upper horizontal edge of panel 328. As best shown in FIG. 21, the appearance of these embodiments is virtually identical to conventional wainscoting as shown and described hereinabove with respect to FIG. 20.

As shown in FIGS. 23-26, various embodiments use a two-piece finishing strip 320', which includes a backing portion 25' with a detachable chair rail portion 326'. The backing portion 25' is configured for being placed along an upper horizontal edge of a panel 28 and fastened to a stud 23 as shown and described hereinabove with respect to finishing strip 20 (FIG. 2), while supporting a detachable chair rail portion 326' on a lip portion 26" of the backing portion 25'. Chair rail portion 326' may be provided with substantially any desirable cross-section to provide a desired decorative appearance and/or functionality. Non-limiting examples of alternative cross-sections for detachable chair rail portions are shown at 326" and 326'" in FIGS. 24 and 25. Advantages of detachable chair rail portions 326', 326", and 326'" include greater flexibility of chair rail styles, e.g., being able to provide a height that would otherwise be difficult to fit the cement panel beneath, due the angle at which the panel is typically placed during insertion, as shown and described hereinabove with respect to FIG. 2. Use of the two-piece finishing strip 320' enables the user to easily slide panel 328 beneath the backing portion 25', and then clip the detachable chair rail portion 326' onto lip portion 26" of backing portion 25', as shown. This two-piece construction also tends to facilitate manufacture, e.g., by enabling each component to be conveniently extruded, e.g., from cellular polyvinylchloride (cellular PVC or "foam PVC"). This approach also advantageously permits convenient replacement of chair rail portions to provide various aesthetic effects.

Figure 26A:
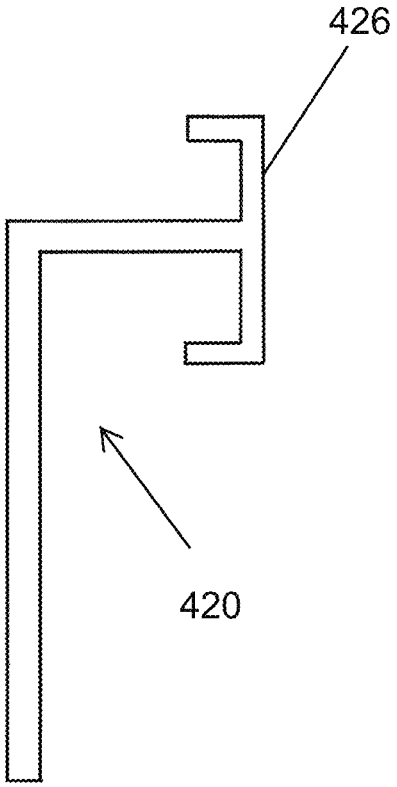
FIG. 26A is a view similar to that of FIG. 3, of a component of an alternate embodiment of the present invention.
Figure 26B:
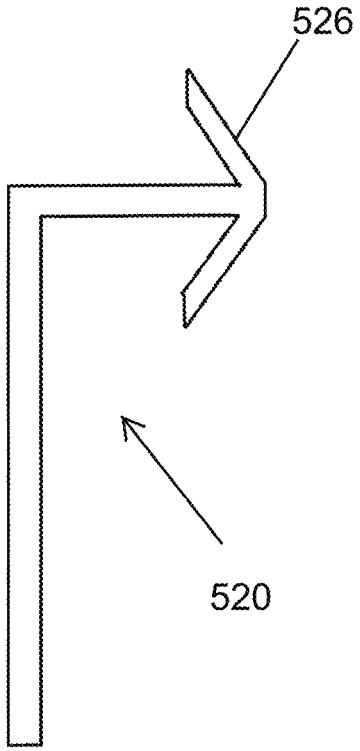
FIG. 26B is a view similar to that of FIG. 26A, of a component of another alternate embodiment of the present invention.

Turning to FIG. 26, alternative versions of the one-piece finishing strip 20 are shown as finishing strips 420, 520 having raised upper lip portions 426, 526, respectively. These lip portions 426 and 526 provide a raised chair rail appearance while providing the ease of manufacture and simplicity of the one-piece strip 20 that may be desirable for particular applications. The skilled artisan will recognize that this one-piece approach may be similarly applied to finishing strip 20', to enable use with thicker (e.g., ⅝") drywall.

The present invention has been described in particular detail with respect to various possible embodiments, and those of skill in the art will appreciate that the invention may be practiced in other embodiments. First, the particular naming of the components, capitalization of terms, the attributes, or any other structural aspect is not mandatory or significant, and the mechanisms that implement the invention or its features may have different names. Also, the particular division of functionality between the various system components described herein is merely exemplary, and not mandatory; functions performed by a single system component may instead be performed by multiple components, and functions performed by multiple components may instead performed by a single component.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims. It should be further understood that any of the features described with respect to one of the embodiments described herein may be similarly applied to any of the other embodiments described herein without departing from the scope of the present invention.

Having thus described the invention, what is claimed is:

1. A modular water-resistant paneling system having component parts capable of being assembled in the field onto wall studs supporting drywall within a room, comprising:

a plurality of water-resistant panels;

a plurality of finishing strips each having a backing flange and an upper lip portion, the backing flange and upper lip portion forming a first receptacle configured as an inverted U and sized and shaped to slidably receive an upper edge portion of one of said plurality of panels therein;

the backing flange configured for being fastened to the wall studs while maintaining the one of said plurality of panels in predetermined spaced relation to the studs, so that a first room-facing surface of said one of said plurality of panels is maintained in flush relation with a second room-facing surface of the drywall;

the upper lip portion including opposing flanges configured for superposed engagement with adjacent portions of said first room-facing surface and said second room-facing surface, respectively; and a plurality of mounting clips sized and shaped for receiving a stud therein, and further having a support flange configured for supporting a lower edge portion of individual ones of said plurality of panels when said upper edge portion is disposed within said first receptacle.

2. The paneling system of claim 1, wherein the plurality of mounting clips each have a face and side flanges configured to form a second receptacle sized and shaped for receiving the stud therein.

3. The paneling system of claim 2, wherein the support flange extends transversely to said side flanges.

4. The paneling system of claim 1, further comprising a water-resistant baseboard.

5. The paneling system of claim 4, further comprising a plurality of horizontal corner strips each having a corner backing flange and a corner lip portion, the corner backing flange and corner lip portion forming corner receptacles each configured as an inverted U and sized and shaped to slidably receive an upper edge portion of one of said plurality of panels therein, the corner strips being universally configurable for forming inside or outside corners, and configured for universal-fit independently of thickness of the drywall.

6. The paneling system of claim 5, further comprising a plurality vertical corner strips having an F-shaped cross-section forming a vertical receptacle to slidably receive a side edge portion of one of said plurality of panels therein, and a vertical flange portion configured for being superposed with the room-facing surface of an adjacent one of said plurality of panels.

7. The paneling system of claim 1, wherein at least one of said plurality of finishing strips comprises a chair rail.

8. The paneling system of claim 7, wherein said chair rail is removably fastened to the at least one of said plurality of finishing strips.

9. The paneling system of claim 1, wherein the backing flange includes an integral offset configured to maintain the one of said plurality of panels in predetermined spaced relation to the studs.

10. A paneling system having component parts capable of being assembled in the field onto wall studs supporting drywall within a room, comprising:

a plurality of water-resistant panels;

a plurality of finishing strips each having a backing flange and an upper lip portion, the backing flange and upper lip portion forming a first receptacle configured as an inverted U and sized and shaped to slidably receive an upper edge portion of one of said plurality of panels therein;

the backing flange configured for being fastened to the wall studs while maintaining the one of said plurality of panels in predetermined spaced relation to the studs, so that a first room-facing surface of said one of said plurality of panels is maintained in flush relation with a second room-facing surface of the drywall;

the upper lip portion including opposing flanges configured for superposed engagement with adjacent portions of said first room-facing surface and said second room-facing surface, respectively;

a plurality of mounting clips each having a face and side flanges configured to form a second receptacle sized and shaped for receiving a stud therein, and further having a support flange extending transversely to said side flanges, the support flange configured for supporting a lower edge portion of individual ones of said plurality of panels when said upper edge portion is disposed within said first receptacle;

a water-resistant baseboard;

a plurality of horizontal corner strips each having a corner backing flange and a corner lip portion, the corner backing flange and corner lip portion forming corner receptacles each configured as an inverted U and sized and shaped to slidably receive an upper edge portion of one of said plurality of panels therein, the corner strips being universally configurable for forming inside or outside corners, and configured for universal-fit independently of thickness of the drywall; and a plurality vertical corner strips having an F-shaped cross-section forming a vertical receptacle to slidably receive a side edge portion of one of said plurality of panels therein, and a vertical flange portion configured for being superposed with the room-facing surface of an adjacent one of said plurality of panels.

11. A method for producing a modular water-resistant paneling system having component parts capable of being assembled in the field onto wall studs supporting drywall within a room, the method comprising:

providing a plurality of water-resistant panels;

configuring a plurality of finishing strips to each have a backing flange and an upper lip portion, the backing flange and upper lip portion forming a first receptacle configured as an inverted U and sized and shaped to slidably receive an upper edge portion of one of said plurality of panels therein;

configuring the backing flange for being fastened to the wall studs while maintaining the one of said plurality of panels in predetermined spaced relation to the studs, so that a first room-facing surface of said one of said plurality of panels is maintained in flush relation with a second room-facing surface of the drywall;

configuring the upper lip portion to include opposing flanges configured for superposed engagement with adjacent portions of said first room-facing surface and said second room-facing surface, respectively; and providing a plurality of mounting clips configured to receive a stud therein, and configured to include a support flange for supporting a lower edge portion of individual ones of said plurality of panels when said upper edge portion is disposed within said first receptacle.

12. The method of claim 11, further comprising configuring the plurality of mounting clips to each have a face and side flanges forming a second receptacle sized and shaped for receiving the stud therein.

13. The method of claim 12, further comprising extending the support flange transversely to said side flanges.

14. The method of claim 11, further comprising providing a water-resistant baseboard.

15. The method of claim 14, further comprising providing a plurality of horizontal corner strips each having a corner backing flange and a corner lip portion, the corner backing flange and corner lip portion forming corner receptacles each configured as an inverted U and sized and shaped to slidably receive an upper edge portion of one of said plurality of panels therein, the corner strips being universally configurable for forming inside or outside corners, and configured for universal-fit independently of thickness of the drywall.

16. The method of claim 15, further comprising providing a plurality vertical corner strips having an F-shaped cross-section forming a vertical receptacle to slidably receive a side edge portion of one of said plurality of panels therein, and a vertical flange portion configured for being superposed with the room-facing surface of an adjacent one of said plurality of panels.

17. The method of claim 11, further comprising configuring at least one of said plurality of finishing strips as a chair rail.

18. The method of claim 17, further comprising removably fastening said chair rail to the at least one of said plurality of finishing strips.

19. The method of claim 11, further comprising configuring the backing flange with an integral offset to maintain the one of said plurality of panels in predetermined spaced relation to the studs.

20. A method for producing a modular water-resistant paneling system having component parts capable of being assembled in the field onto wall studs supporting drywall within a room, the method comprising:

providing a plurality of water-resistant panels;

configuring a plurality of finishing strips to each have a backing flange and an upper lip portion, the backing flange and upper lip portion forming a first receptacle configured as an inverted U and sized and shaped to slidably receive an upper edge portion of one of said plurality of panels therein;

configuring the backing flange for being fastened to the wall studs while maintaining the one of said plurality of panels in predetermined spaced relation to the studs, so that a first room-facing surface of said one of said plurality of panels is maintained in flush relation with a second room-facing surface of the drywall;

configuring the upper lip portion to include opposing flanges configured for superposed engagement with adjacent portions of said first room-facing surface and said second room-facing surface, respectively;

providing a plurality of mounting clips each having a face and side flanges configured to form a second receptacle sized and shaped for receiving a stud therein, and further having a support flange extending transversely to said side flanges, the support flange configured for supporting a lower edge portion of individual ones of said plurality of panels when said upper edge portion is disposed within said first receptacle;

providing a water-resistant baseboard;

providing a plurality of horizontal corner strips each having a corner backing flange and a corner lip portion, the corner backing flange and corner lip portion forming corner receptacles each configured as an inverted U and sized and shaped to slidably receive an upper edge portion of one of said plurality of panels therein, the corner strips being universally configurable for forming inside or outside corners, and configured for universal-fit independently of thickness of the drywall; and providing a plurality vertical corner strips having an F-shaped cross-section forming a vertical receptacle to slidably receive a side edge portion of one of said plurality of panels therein, and a vertical flange portion configured for being superposed with the room-facing surface of an adjacent one of said plurality of panels.

* * * * *